US007695252B2

(12) United States Patent
Sakikawa

(10) Patent No.: US 7,695,252 B2
(45) Date of Patent: Apr. 13, 2010

(54) PUMP SYSTEM AND PUMP UNIT

(75) Inventor: Shigenori Sakikawa, Hyogo (JP)

(73) Assignee: Kanzaki Kokyukoki Mfg. Co., Ltd., Hyogo (JP)

( * ) Notice: Subject to any disclaimer, the term of this patent is extended or adjusted under 35 U.S.C. 154(b) by 744 days.

(21) Appl. No.: 11/167,609

(22) Filed: Jun. 28, 2005

(65) Prior Publication Data

US 2006/0013705 A1 Jan. 19, 2006

(30) Foreign Application Priority Data

Jul. 15, 2004 (JP) ..... 2004-208012

(51) Int. Cl.
*F04B 1/12* (2006.01)
*F01B 3/02* (2006.01)

(52) U.S. Cl. ..... 417/269; 91/499; 91/505

(58) Field of Classification Search ..... 92/128; 60/484, 486; 91/499, 504, 505
See application file for complete search history.

(56) References Cited

U.S. PATENT DOCUMENTS 4,957,417 A * 9/1990 Tsuboi ..... 417/423.13
6,471,494 B1 * 10/2002 Miura et al. ..... 417/410.4
6,487,856 B1 * 12/2002 Ohashi et al. ..... 60/464
6,672,843 B1 * 1/2004 Holder et al. ..... 417/201
6,772,591 B2 * 8/2004 Ohashi et al. ..... 60/484

FOREIGN PATENT DOCUMENTS

JP 54043608 3/1979
JP 2001-116107 4/2001
JP 2001-263259 9/2001
JP 2003-291674 10/2003

OTHER PUBLICATIONS

Notification of reasons for rejection (with English language translation), JP Patent Appl. No. 2004-208012, Japanese Patent Office, mailed Aug. 7, 2009, 4 pgs.

* cited by examiner

*Primary Examiner*—Devon C Kramer
*Assistant Examiner*—Philip Stimpert
(74) *Attorney, Agent, or Firm*—Sterne, Kessler, Goldstein & Fox P.L.L.C.

(57) ABSTRACT

A pump system has a base unit and a pump unit. The base unit includes an input part operatively connected to a driving source and a plurality of output parts to which power is transmitted from the input part. The base unit is capable of being mounted to a support member. The pump unit includes a plurality of pump shafts respectively driven by the plurality of output parts, a plurality of hydraulic pump bodies respectively driven by the plurality of pump shafts, and a plurality of pump cases for respectively surrounding the plurality of hydraulic pump bodies, the pump unit detachably connected to the base unit. The pump shafts are connected to the corresponding output parts by connecting the pump cases to the base unit.

4 Claims, 24 Drawing Sheets

PUMP SYSTEM AND PUMP UNIT

BACKGROUND OF THE INVENTION

1. Field of the Invention

The present invention relates to a pump system including a plurality of hydraulic pump bodies, and a pump unit having a cooling fan unit.

2. Related Art

Conventionally, a pump unit has been widely used in a traveling power transmission mechanism in a working vehicle or the like. The pump unit includes a single input shaft, a plurality of pump shafts operatively connected to the input shaft, a plurality of hydraulic pump bodies respectively driven by the plurality of pump shafts, a pump case for accommodating the plurality of hydraulic pump bodies and supporting the input shaft and the plurality of pump shafts, and a port block connected to the pump case (see, for example, JP-A 2003-291674).

In the conventional pump unit, the input shaft can be operatively connected to a driving source through a power transmission mechanism such as a pulley with the pump case connected to a support member such as a vehicle frame, and the plurality of hydraulic pump bodies can be driven through a single input path.

However, the conventional pump unit has a room for improvement in workability in replacing or maintaining the hydraulic pump bodies.

In other words, in the conventional pump unit, the pump case is connected to the support member such as the vehicle frame.

Therefore, for replacing or maintaining the hydraulic pump bodies, it is necessary to separate the whole pump unit including the input shaft from the support member or to separate the port block from the pump case.

In the former method, it is necessary to release an engagement between the input shaft and the power transmission mechanism from each other. In the latter method, it is necessary to separate the port block from the pump case with the pump case connected to the support member such as the vehicle frame. Therefore, workability is poor and constituent parts of the hydraulic pump bodies may be unintentionally detached.

Although the pump unit may be provided with a charge pump body and a cooling fan body in some cases depending on specifications, there is no pump unit to which those members can easily and conveniently be attached.

The present invention has been accomplished in view of the aforementioned conventional art and it is an object of the present invention to provide a pump system in which efficiency of replacement and maintenance operation of the hydraulic pump bodies can be increased.

It is another object of the present invention to provide a pump unit to/from which a cooling fan and/or a charge pump can be easily attached/detached.

SUMMARY OF THE INVENTION

According to one aspect of the present invention, there is provided a pump system having a base unit and a pump unit.

The base unit includes an input part operatively connected to a driving source and a plurality of output parts to which power is transmitted from the input part. The base unit is capable of being mounted to a support member.

The pump unit includes a plurality of pump shafts respectively driven by the plurality of output parts, a plurality of hydraulic pump bodies respectively driven by the plurality of pump shafts, and a plurality of pump cases for respectively surrounding the plurality of hydraulic pump bodies, wherein the pump unit is detachably connected to the base unit.

The pump shafts are connected to the corresponding output parts by connecting the pump cases to the base unit.

With the pump system according to the present invention, by connecting the pump cases to the base unit including the input part operatively connected to the driving source and the plurality of output parts to which power is transmitted from the input part, corresponding pump shafts are connected to the corresponding output parts, respectively.

Therefore, it is possible to replace or maintain the hydraulic pump bodies with the base unit connected to and supported on a support member such as a vehicle frame without detaching a power transmitting mechanism from the driving source to the base unit.

The plurality of pump cases respectively have openings through which the corresponding hydraulic pump bodies can be inserted at ends of the pump cases on opposite sides to the portions of the pump cases to be connected to the base unit.

In one embodiment, the pump unit includes a plurality of port blocks respectively connected to the plurality of pump cases so as to close the openings.

Preferably, the plurality of pump cases can be connected to the base unit at different positions around the corresponding pump shafts, respectively.

In another embodiment, the pump unit includes a single common port block connected to the plurality of pump cases so as to close the openings of the plurality of pump cases.

Preferably, the plurality of pump cases can be connected to the base unit and the common port block at different positions around the corresponding pump shafts, respectively.

In the above various configurations, the pump system may further include at least one auxiliary pump unit operatively driven by one of the plurality of pump shafts. The auxiliary pump unit includes an auxiliary pump body operatively driven by an end of the corresponding pump shaft on an opposite side to an end of the pump shaft to be connected to the output part, and an auxiliary pump case for surrounding the auxiliary pump body.

In the above various configurations, the pump system may further include at least one cooling fan operatively driven by one of the plurality of pump shafts. The cooling fan is operatively driven by an end of the corresponding pump shaft on an opposite side to an end of the pump shaft to be connected to the output part.

In the above various configurations, the base unit includes an input shaft forming the input part and a plurality of output shafts respectively forming the plurality of output parts.

Alternatively, the base unit includes a plurality of output shafts respectively forming the plurality of output parts. One of the plurality of output shafts or one of the plurality of pump shafts forms the input part.

In the above various configurations, the pump system may further include a second cooling fan operatively driven by the input part.

According to another aspect of the present invention, there is provided a pump unit including a pump shaft, a hydraulic pump body, a pump case, a port block, an auxiliary case and a cooling fan.

The pump shaft has a first end operatively connected to a driving source. The hydraulic pump body is operatively driven by the pump shaft. The pump case surrounds the hydraulic pump body and has an opening through which the hydraulic pump body can be inserted. The port block has a first through hole for supporting the pump shaft and is connected to the pump case so as to close the opening. The auxiliary case is connected to the port block and has a second through hole disposed concentrically with the first through hole. The cooling fan unit is operatively driven by a second end of the pump shaft.

In the pump unit, the cooling fan unit includes a fan shaft connected to the pump shaft in a relatively non-rotatable manner about an axis while in contact with the second of the pump shaft in the first through hole or the second through hole, and a fan body not rotatable relative to the fan shaft.

The second through hole has a large-diameter hole opened at an outer surface on an opposite side to the port block, and a small-diameter hole extending inward to approach the port block from the large-diameter hole through a step portion.

The fan shaft has a small-diameter portion bearing-supported in the large-diameter hole through a bearing member, and a large-diameter portion extending inward to approach the port block from the small-diameter portion through a step portion and positioned in the small-diameter hole.

The bearing member has an outer ring body engaged with the step portion of the second through hole, an inner ring body engaged with the step portion of the fan shaft, and rolling elements disposed between the outer ring body and the inner ring body.

The pump unit further includes a withdrawal preventing member for preventing the bearing member from moving in such a direction as to withdraw outward from the large-diameter hole.

With this configuration, it is possible to extremely easily connect the fan shaft to the pump shaft and to detach the fan shaft from the pump shaft.

Preferably, the withdrawal preventing member has a retaining plate detachably mounted to an outer surface of the auxiliary case.

More preferably, a seal member is interposed between the retaining plate and the bearing member.

In one embodiment, the pump shaft and the fan shaft are connected to each other in a non-rotatable manner about an axis with their opposed ends in contact with each other in the first through hole.

Preferably, the pump unit may further include an auxiliary pump body driven by the fan shaft. The auxiliary case surrounds the auxiliary pump body in cooperation with the port block.

In another embodiment, the pump shaft and the fan shaft are connected to each other in a relatively non-rotatable manner about an axis with their opposed ends in contact with each other in the second through hole.

Preferably, the pump unit may further include an auxiliary pump body driven by the pump shaft. The auxiliary case surrounds the auxiliary pump body in cooperation with the port block.

BRIEF DESCRIPTION OF THE DRAWINGS

The above, and other objects, features and advantages of the present invention will become apparent from the detailed description thereof in conjunction with the accompanying drawings.

DETAILED DESCRIPTION OF THE PREFERRED EMBODIMENTS

Embodiment 1

A preferred first embodiment of a pump system according to the present invention will be described below with reference to the accompanying drawings.

Figure 1:
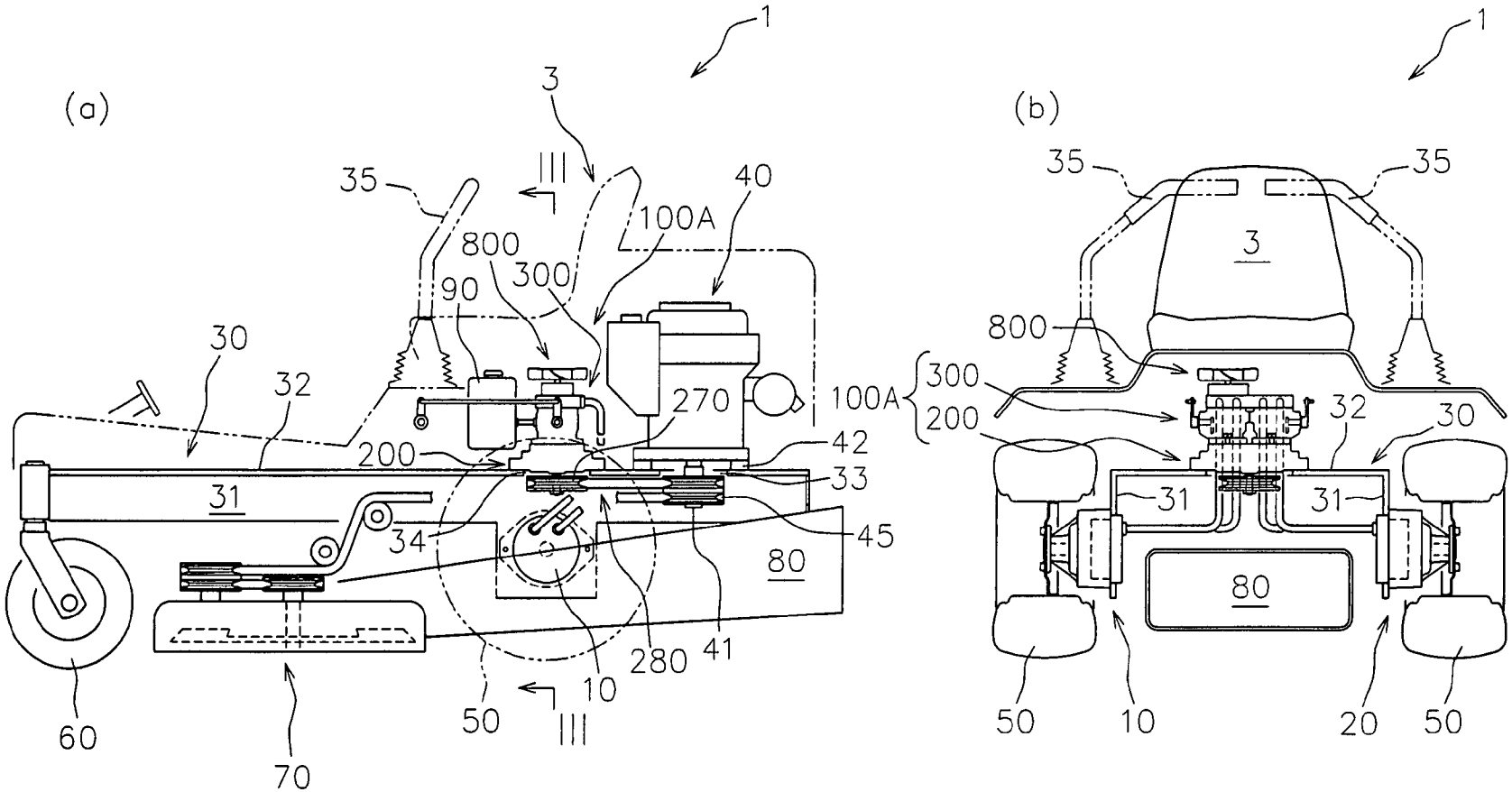
FIGS. 1(*a*) and 1(*b*) are a side view and a rear view, respectively, of a working vehicle to which a first embodiment of a pump system according to the present invention is applied.

FIGS. 1(*a*) and 1(*b*) are a side view and a rear view, respectively, of a working vehicle 1 to which a pump system 100A according to this embodiment is applied.

Figure 2:
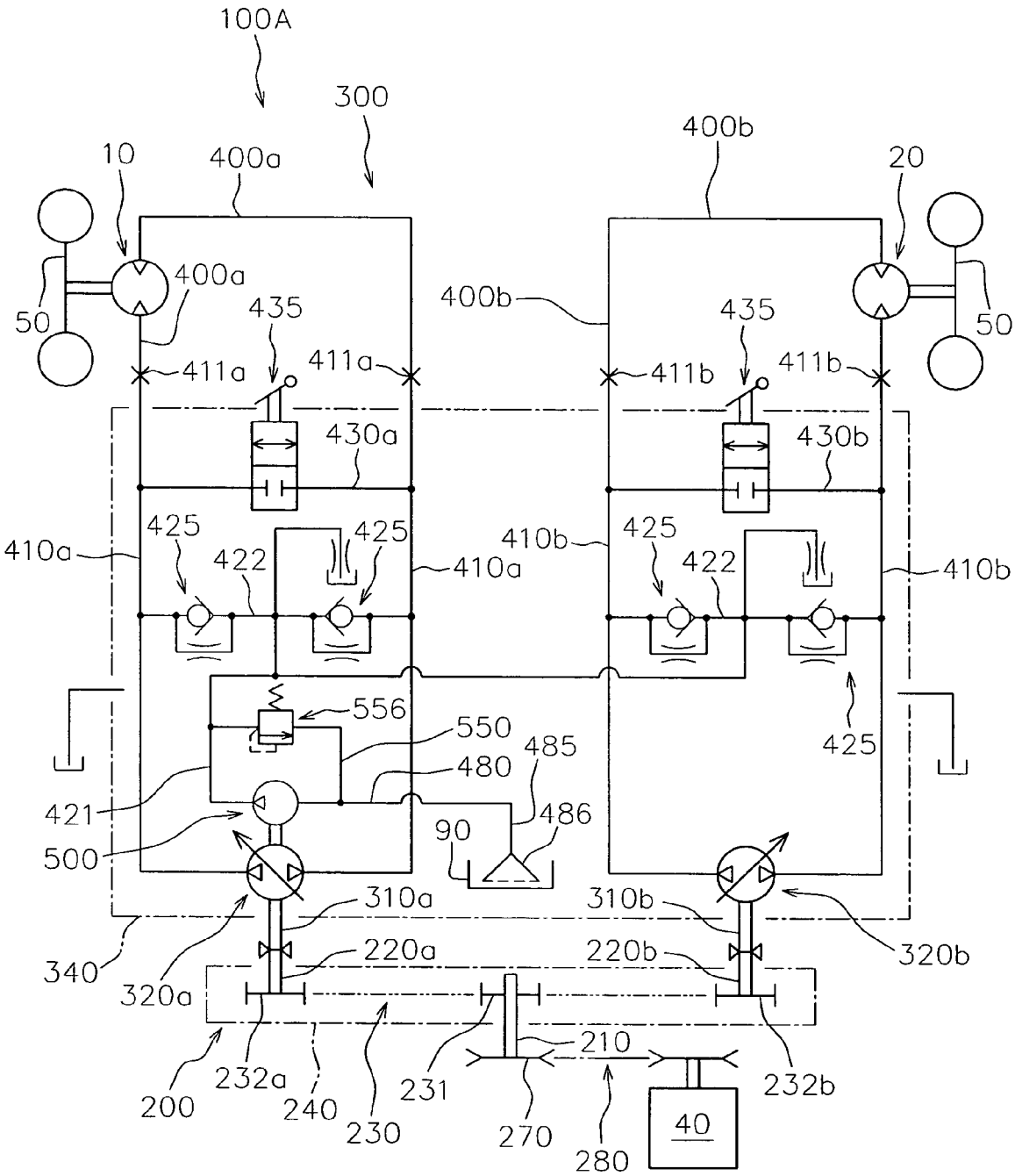
FIG. 2 is a hydraulic circuit diagram of the pump system.
Figure 3:
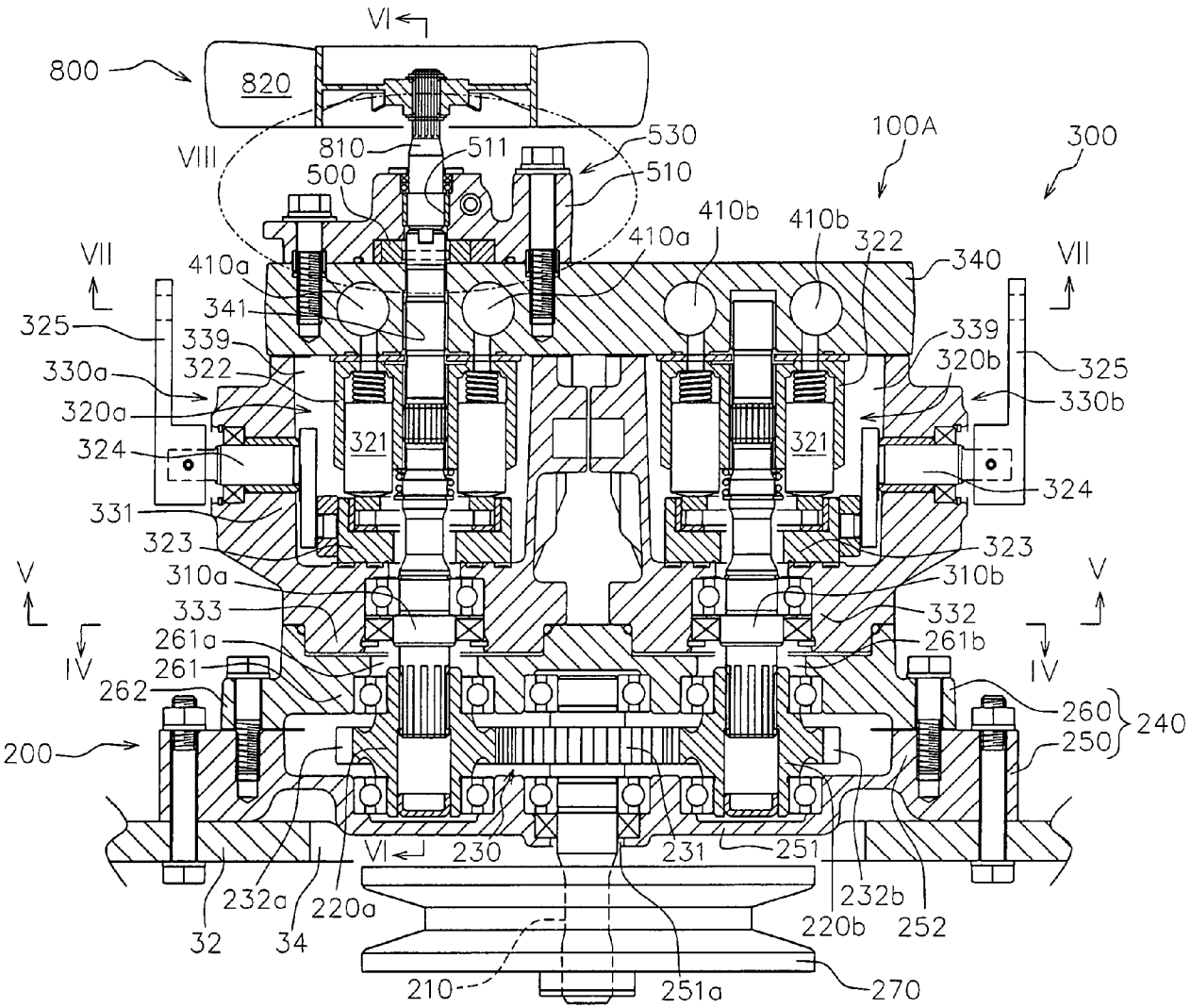
FIG. 3 is a vertical rear view of the pump system taken along line III-III in FIG. 1(*a*).

FIG. 2 is a hydraulic circuit diagram of the pump system 100A. FIG. 3 is a vertical rear view of the pump system 100A taken along line III-III in FIG. 1(*a*).

As shown in FIGS. 1(*a*), 1(*b*) and 2, in this embodiment, the pump system 100A forms a traveling speed change power transmission mechanism in cooperation with a pair of first and second hydraulic motor units 10 and 20 provided in the working vehicle 1.

Specifically, the working vehicle 1 includes a vehicle frame 30, a driving source 40 mounted to the vehicle frame 30, the pump system 100A supported on the vehicle frame 30, the pair of first and second hydraulic motor units 10 and 20 fluidly connected to the pump system 100A, and a pair of left and right driving wheels 50 respectively driven by the pair of first and second hydraulic motor units 10 and 20.

Reference numerals 60, 70, and 80 in FIGS. 1(*a*) and 1(*b*) respectively denote a caster, a mower device operatively driven by the driving source 40, and a discharge duct forming a conveyance path for conveying grass mowed by the mower device 70 to the rear of the vehicle.

The pump system 100A according to this embodiment includes a base unit 200 mounted to a support member (the vehicle frame 30 in this embodiment) and a pump unit 300 detachably connected to the base unit 200.

The base unit 200 has a single input part which can be operatively connected to the driving source 40 and a plurality of output parts which can output power transmitted from the input part to the outside.

Figure 4:
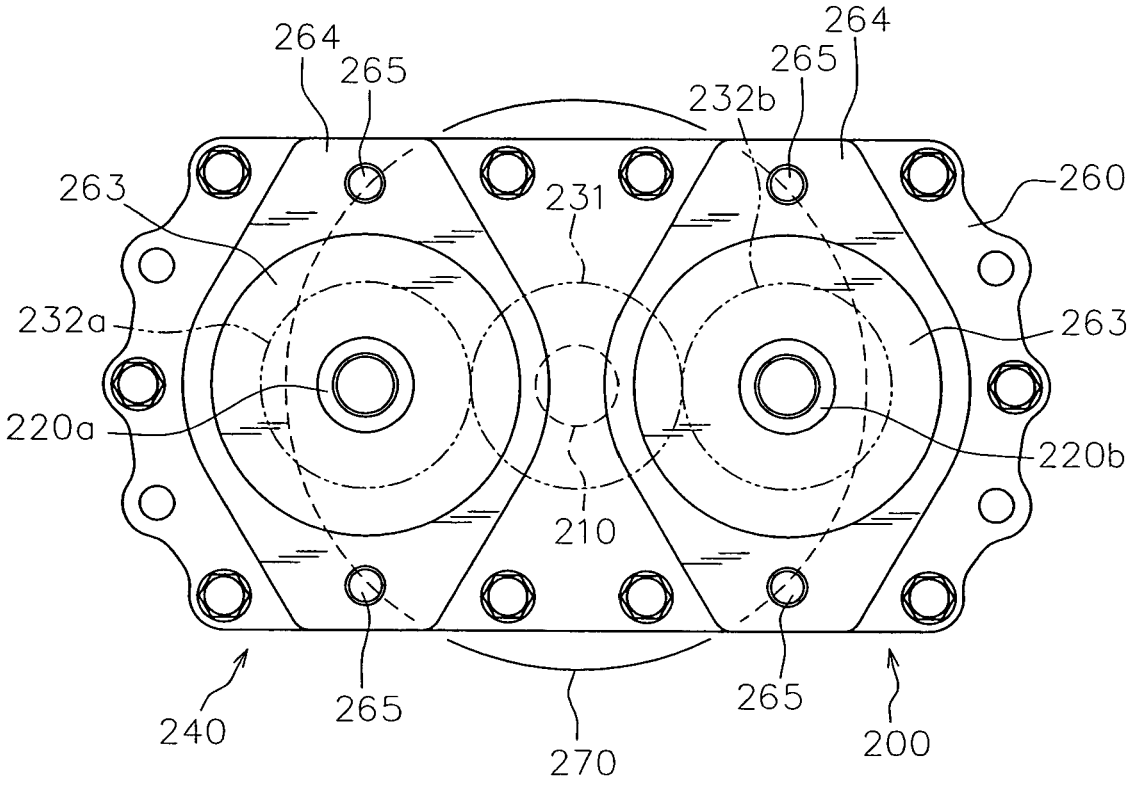
FIG. 4 is an end view taken along line IV-IV in FIG. 3.
Figure 5:
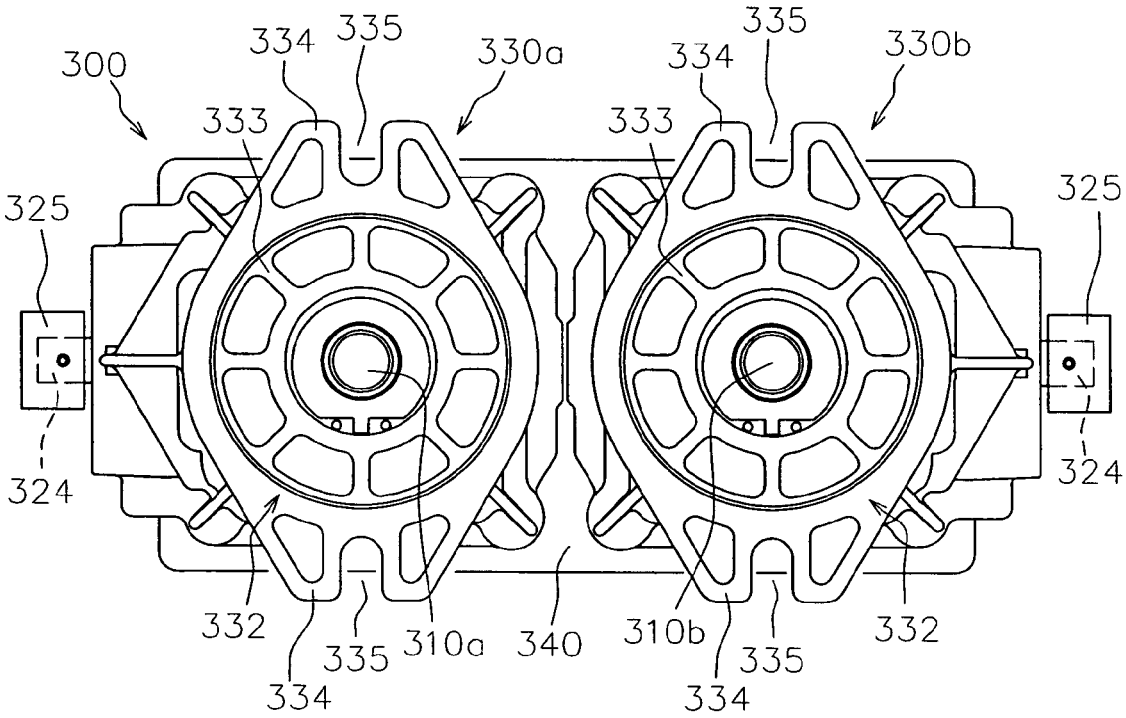
FIG. 5 is an end view taken along line V-V in FIG. 3.

FIGS. 4 and 5 are end views taken along lines IV-IV and V-V in FIG. 3, respectively.

Specifically, as shown in FIGS. 3 to 5, the base unit 200 includes an input shaft 210 forming the input part, first and second output shafts 220*a*, 220*b* forming the plurality of output parts, a power transmission part 230 for operatively connecting the input shaft 210 to the first and second output shafts 220*a* and 220*b*, and a base housing 240 for supporting the input shaft 210 and the first and second output shafts 220*a* and 220*b* and for accommodating the power transmission part 230.

In this embodiment, the base housing 240 is placed on an upper face of the vehicle frame 30.

Specifically, the working vehicle 1 has, as shown in FIGS. 1(*a*) and 1(*b*), a pair of main frame portions 31 extending in a longitudinal direction of the vehicle, and a cross member 32 for connecting the pair of main frame portions 31 to each other.

The base housing 240 includes, as shown in FIG. 3, a first housing portion 250 placed on an upper face of the cross member 32, and a second housing portion 260 connected to the first housing portion 250 in such a manner as to form an accommodating space for accommodating the power transmission part 230 in cooperation with the first housing portion 250.

In this embodiment, the driving source 40 is an internal combustion engine and is mounted onto the vehicle frame 30 with a driving shaft oriented vertically as shown in FIG. 1(*a*). The base housing 240 supports the input shaft 210 with an axis oriented along the vertical direction so as to easily and operatively connect the input shaft 210 to the driving source 40.

More specifically, as shown in FIG. 1(*a*), the driving source 40 is placed on the vehicle rear side of the cross member 32 through elastic members 42 in such a manner that a shaft end of the driving shaft 41 extends under the cross member 32.

In other words, the cross member 32 has a first opening 33 at a portion corresponding to the driving source 40 as shown in FIG. 1(*a*).

The driving source 40 is mounted to the upper face of the cross member 32 through the elastic members 42 in such a manner that a driving pulley 45 attached to the shaft end of the driving shaft 41 is positioned under the cross member 32 through the first opening 33.

The base housing 240 is mounted to the upper face of the cross member 32 in such a manner that a shaft end of the input shaft 210 and a driven pulley 270 attached to the shaft end are positioned under the cross member 32.

Specifically, at the front of the first opening 33, the cross member 32 is formed with a second opening 34 through which the driven pulley 270 can be inserted (see FIGS. 1(*a*) and 3)

The base housing 240 is connected to the upper face of the cross member 32 with the driven pulley 270 passed through the second opening 34 from above and positioned under the cross member 32.

Concretely, the first housing portion 250 includes a first end wall 251 having a through hole 251*a* through which the input shaft 210 is passed, and a first peripheral wall 252 extending in an axial direction of the input shaft 210 from a peripheral edge of the first end wall 251.

Likewise, the second housing portion 260 includes a second peripheral wall 262 extending in the axial direction of the input shaft 210, and a second end wall 261 extending radially inward from the second peripheral wall 262 so as to face the first end wall 251.

The first and second housing portions 250 and 260 are detachably connected to each other with end faces of the first peripheral wall 252 and the second peripheral wall 262 in contact with each other.

The base housing 240 supports the input shaft 210 on a first side thereof and the first output shaft 220*a* and the second output shaft 220*b* on a second side thereof in such a manner that they are respectively accessible from outside.

Specifically, in this embodiment, the first and second output shafts 220*a* and 220*b* are accommodated in the accommodating space defined by the base housing 240, as shown in FIG. 3.

The second end wall 261 of the second housing portion 260 is formed with first and second access openings 261*a* and 261*b* for allowing access to the first and second output shafts 220*a* and 220*b* from outside (see FIGS. 3 and 4).

It is of course possible that the first and second output shafts 220*a* and 220*b* are supported in the base housing 240 with their one ends extending outside the base housing 240 instead of the form shown in the drawings.

The power transmission part 230 is formed so as to operatively connect the input shaft 210 to the first and second output shafts 220*a* and 220*b* as described above.

Concretely, the power transmission part 230 includes an input gear 231 which cannot rotate relative to the input shaft 210, and first and second output gears 232*a* and 232*b* which cannot rotate relative to the first and second output shafts 220*a* and 220*b*, respectively, and mesh with the input gear 231.

In this embodiment, the first and second output gears 232*a* and 232*b* are connected to the input gear 231 in parallel. However, it is of course possible to connect the first and second output gears 232*a* and 232*b* to the input gear 231 in series.

In other words, it is possible to mesh one of the first and second output gears 232*a* and 232*b* with the input gear 231, and to mesh the first and second output gears 232*a* and 232*b* with each other.

The pump unit 300 includes a plurality of pump shafts respectively driven by the plurality of output parts in the base unit 200, a plurality of hydraulic pump bodies respectively driven by the plurality of pump shafts, and a plurality of pump cases for respectively surrounding the plurality of hydraulic pump bodies.

Figure 6:
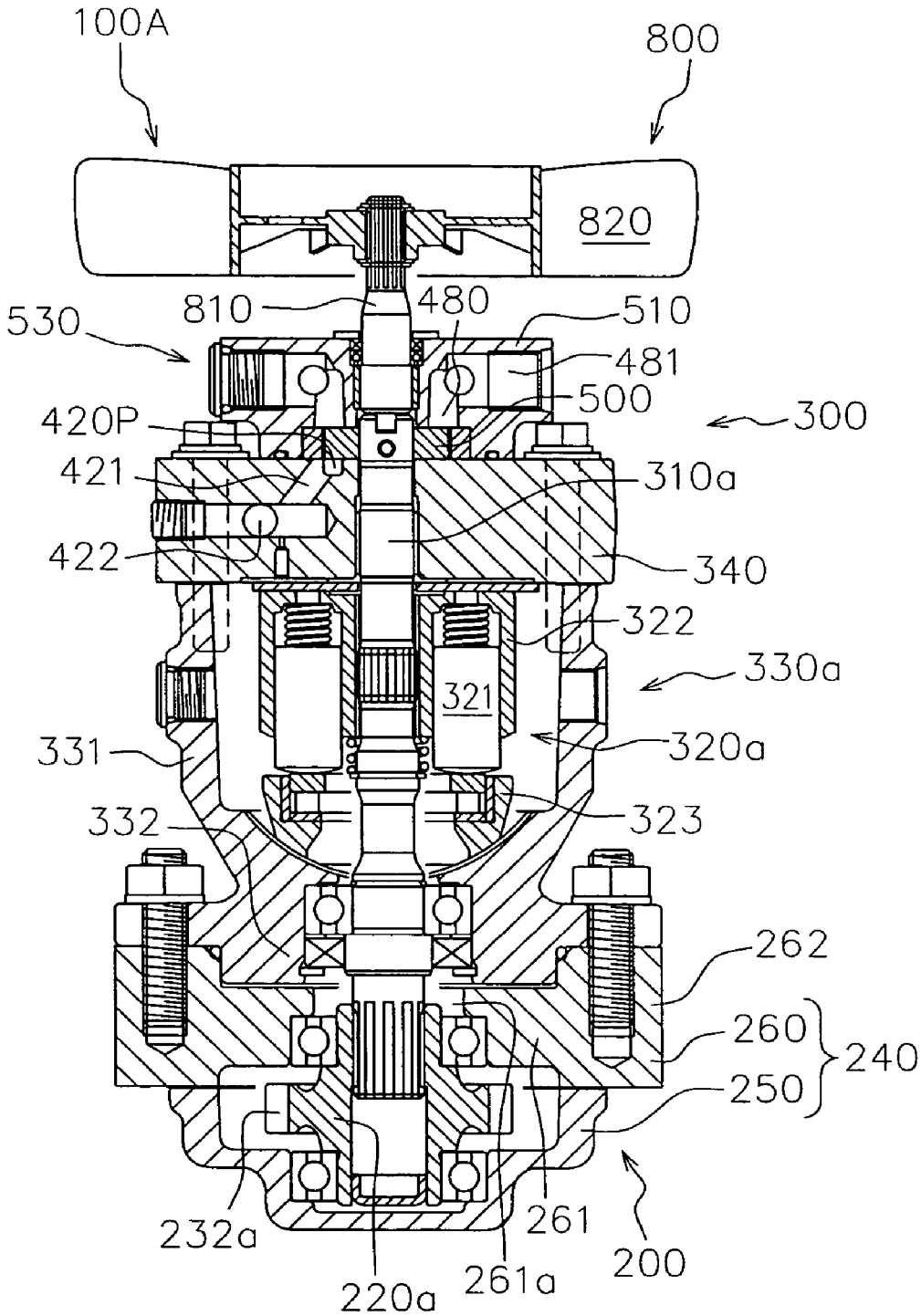
FIG. 6 is a sectional view taken along line VI-VI in FIG. 3.

FIG. 6 is a sectional view taken along line VI-VI in FIG. 3.

As described above, in this embodiment, the base unit 200 has the two output shafts, i.e. the first and second output shafts 220*a* and 220*b*. Therefore, the pump unit 300 has first and second pump shafts 310*a* and 310*b*, first and second hydraulic pump bodies 320*a* and 320*b*, and first and second pump cases 330*a* and 330*b* as shown in FIGS. 3 and 6.

The second pump shaft 310*b*, the second hydraulic pump body 320*b* and the second pump case 330*b* have substantially the same configurations as the first pump shaft 310*a*, the first hydraulic pump body 320*a* and the first pump case 330*a*, respectively.

Therefore, the last character of reference numerals of the first pump shaft 310*a*, the first hydraulic pump body 320*a* and the first pump case 330*a* are merely changed to "b" to omit detailed descriptions of the second pump shaft 310*b*, the second hydraulic pump body 320*b* and the second pump case 330*b*.

The first pump case 330*a* includes, as shown in FIGS. 3 and 6, a peripheral wall 331 extending along an axial direction of the corresponding first pump shaft 310*a* and an end wall 332 for closing a fist axial end side of the peripheral wall 331. A second axial end side of the peripheral wall 331 is formed with an opening 339 through which the corresponding first hydraulic pump body 320*a* can be inserted.

The first pump case 330*a* is formed so that the end wall 332 can detachably be connected to an outer surface of the second housing portion 260.

Concretely, the end wall 332 has, as shown in FIG. 5, a center part 333 facing the corresponding first hydraulic pump body 320*a*, and flange parts 334 extending radially outward from the center part 333.

Each of the flange parts 334 is formed with an engaging hole or engaging groove 335 through which a fastening member such as a bolt is inserted.

By fastening the fastening members inserted through the engaging holes or engaging grooves 335 in the flange parts 334 into screw holes 265 formed in the outer surface of the second housing portion 260, the first pump case 330*a* can be connected to the second housing portion 260.

The outer surface of the second housing portion 260 on which the first and second pump cases 330*a* and 330*b* are disposed is opposite to the side on which the input shaft 210 protrudes and is the face where the first and second output shafts 220*a* and 220*b* are accessible. With such a configuration, it is possible to prevent the first and second pump cases 330*a* and 330*b* from interfering with the input shaft 210.

Preferably, the center part 333 is formed to be engaged with the outer surface of the second housing portion 260 through a convex and a concave.

In this embodiment, as shown in FIGS. 3 to 5, the center part 333 has a convex shape with its center aligned with an axial center of the first pump shaft 310*a*. The outer surface of the second housing portion 260 is formed with a concave center part 263 to be engaged with the convex and having a center aligned with an axial center of the first output shaft 220*a*.

Specifically, the second housing portion 260 has the concave center part 263 and flange parts 264 respectively corresponding to the convex center part 333 and the flange parts 334 of the first pump case 330*a*.

The concave center part 263 and the convex center part 333 are formed to be engaged with each other through the concave and the convex.

Each of the flange parts 264 is formed with the screw hole 265.

According to the configuration, by fastening the first pump case 330*a* and the second housing portion 260 to each other with the convex center part 333 of the first pump case 330*a* and the concave center part 263 of the second housing portion 260 engaged with each other through the concave and the convex, the first pump case 330*a* can be stably supported on the second housing portion 260 with axial centers of the first pump shaft 310*a* and the first output shaft 220*a* aligned with each other.

The first pump shaft 310*a* is supported in the first pump case 330*a* so that the first pump shaft 310*a* is connected to the corresponding first output shaft 220*a* by connecting the end wall 332 of the first pump case 330*a* to the second housing portion.

As described above, in this embodiment, the first output shaft 220*a* is accommodated in the base housing 240.

Therefore, the first pump shaft 310*a* extends outside the first pump case 330*a* so that one end thereof can be connected to the first output shaft 220*a* through the first access opening 261*a* when the first pump case 330*a* and the second housing portion 260 are connected (see FIGS. 3 and 6).

In this embodiment, the first and second output shafts 220*a* and 220*b* are hollow shafts, and male splines carved on outer peripheral faces of extensions of the first and second pump shafts 310*a* and 310*b* are connected with female splines carved in inner peripheral faces of central holes of the first and second output shafts 220*a* and 220*b*. However, various connection structures can be employed as long as the pump shaft and the corresponding output shaft can be connected in a relatively non-rotatable manner. The first hydraulic pump body 320*a* has, as shown in FIGS. 3 and 6, a piston unit 321 for reciprocating as the first pump shaft 310*a* rotates, and a cylinder block 322 for supporting the piston unit 321 in a reciprocatable manner.

As described above, in this embodiment, the first hydraulic pump body 320*a* is of a variable displacement type.

Therefore, the first pump body 320*a* has, in addition to the aforementioned configuration, an output-adjusting member 323 for adjusting suction/discharge rates by changing a sliding range of the piston unit.

In this embodiment, a movable swash plate is used as the output-adjusting member 323, and a shoe provided to a distal end of the piston unit 321 is brought into contact with the swash plate.

The output-adjusting member 323 can be operated from outside by using a control shaft 324. In this embodiment, the control shaft 324 integrally has an arm engaged with the output-adjusting member 323, and the output-adjusting member 323 is tilted through the arm by rotating the control shaft 324 around an axis.

In this embodiment, as shown in FIGS. 1(*b*) and 3, the first pump body 320*a* and the second pump body 320*b* are formed so that their control shafts 324 extend in opposite directions.

In other words, the control shaft 324 for controlling output of the first pump body 320*a* extends to a first side in a width direction of the vehicle, and the control shaft 324 for controlling output of the second hydraulic pump body 320*b* extends to a second side in the width direction of the vehicle.

Each of the control shafts 324 extending in the first and second sides (vehicle leftward and rightward) in the width direction of the vehicle is linked to left and right speed-change levers 35 (see FIGS. 1(*a*) and 1(*b*)) arranged in the vicinity of a driver's seat 3 of the working vehicle 1 through an operating arm 325 (see FIG. 3) and a flexible operating power transmission mechanism (not shown) such as a wire connected to the operating arm.

The pump unit 300 includes, as shown in FIGS. 3 and 6, a single common port block 340 connected to the first and second pump cases 330*a*, 330*b* in such a manner as to close both the openings 339 of the first and second pump cases 330*a*, 330*b*.

Figure 7:
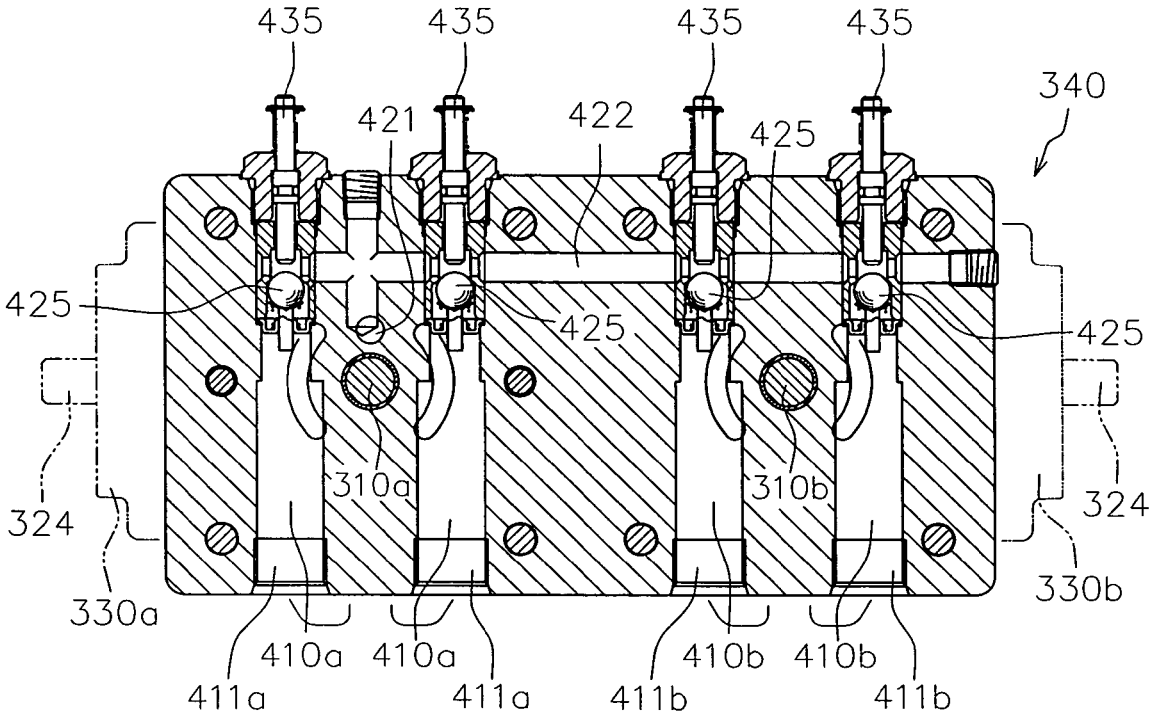
FIG. 7 is a horizontal sectional view of a common port block of the pump system taken along line VII-VII in FIG. 3.

FIG. 7 is a horizontal sectional view of the common port block 340 taken along line VII-VII in FIG. 3.

As shown in FIGS. 2 and 7, the port block 340 is provided with a pair of first hydraulic fluid passages 410*a* forming parts of a pair of first hydraulic fluid lines 400*a* for fluidly connecting the first hydraulic pump body 320*a* and a hydraulic motor body in the first hydraulic motor unit 10, a first bypass oil passage 430*a* for communicating between the pair of first hydraulic fluid passages 410*a*, a pair of second hydraulic fluid passages 410*b* forming parts of a pair of second hydraulic fluid lines 400*b* for fluidly connecting the second hydraulic pump body 320*b* and a hydraulic motor body in the second hydraulic motor body 20, and a second bypass oil passage 430*b* for communicating between the pair of second hydraulic fluid passages 410*b*.

In this embodiment, as shown in FIG. 7, the pair of first hydraulic fluid passages 410*a* and the pair of second hydraulic fluid passages 410*b* are formed substantially parallel so as to respectively extend in directions perpendicular to axial directions of the control shafts 324.

Moreover, the port block 340 is provided with a first charge oil passage 421 having a first end opened at an outer surface to form a charge port 420P, and a second charge oil passage 422 connected to the first charge oil passage 421 and extending parallel to the axes of the control shafts so as to cross the pair of first hydraulic fluid passages 410*a* and the pair of second hydraulic fluid passages 410*b*.

Between the pair of first hydraulic fluid passages 410*a* and the second charge oil passage 422, and between the pair of second hydraulic fluid passages 410*b* and the second charge oil passage 422, check valves 425 which will be described later are respectively interposed.

As shown in FIG. 7, the pair of first hydraulic fluid passages 410*a* respectively have first ends opened at an outer surface (rear face in this embodiment) on a first side of the common port block 340 to form a pair of first hydraulic fluid ports 411*a*, second ends opened at an outer surface (front face in this embodiment) on a second side of the common port block 340, and substantially center parts fluidly connected to the first hydraulic pump body 320*a* through kidney ports.

The respective second ends of the pair of first hydraulic fluid passages 410*a* are sealed with plugs connected to valve cases of the check valves 425 which will be described later.

Likewise, the pair of second hydraulic fluid passages 410*b* respectively have first ends opened at the outer surface (rear face in this embodiment) on the first side of the common port block 340 to form a pair of second hydraulic fluid ports 411*b*, second ends opened at the outer surface (front face in this embodiment) on the second side of the common port block 340 and substantially center parts fluidly connected to the second hydraulic pump body 320*b* through kidney ports.

The respective second ends of the pair of second hydraulic fluid passages 410*b* are sealed with plugs connected to the valve cases of the check valves 425 which will be described later.

The common port block 340 is provided with a pair of kidney-shaped oil suction/discharge ports opened at a surface (surface opposed to the first hydraulic pump body 320*a*) which is faced toward the inside of the first pump case 330*a*.

As shown in FIG. 7, in this embodiment, the pair of oil suction/discharge ports are disposed so that their longitudinal directions are substantially parallel to the pair of first hydraulic fluid passages 410*a* and are formed deep in a thickness direction of the port block 340 to thereby respectively communicate with the pair of first hydraulic fluid passages 410*a*.

In this embodiment, as shown in FIGS. 2 and 3, the pump unit 300 includes a charge pump unit 530 in addition to the above configuration.

The charge pump unit 530 has a charge pump body 500 driven by the first pump shaft 310*a*, and a charge pump case 510 connected to the port block 340 so as to surround the charge pump body 500.

Specifically, the second end of the first pump shaft 310*a* on the opposite side to the first end connected to the first output shaft 220*a* passes through the common port block 340 and extends outside.

The outside extension of the first pump shaft 310*a* drives the charge pump body 500.

In this embodiment, pressure oil from the charge pump body 500 is supplied to the first charge oil passage 421.

Specifically, as shown in FIGS. 1(*b*) and 6, the charge pump case 510 is formed with a supply oil passage 480 having a first end opened at an outer surface to form a suction port 481 and a second end opened at a face in contact with the port block 340 to form a discharge port.

The charge pump body 500 is interposed in the supply oil passage 480.

In this embodiment, the suction port 481 is fluidly connected to an external reserve tank 90 (see FIGS. 1(*a*) and 2) through a proper external conduit 485 and filter 486 (see FIG. 2).

The first charge oil passage 421 is formed to lead the pressure oil sent from the supply oil passage 480 to the second charge oil passage 422.

Concretely, as shown in FIGS. 2 and 6, the first charge oil passage 421 has a first end opened at a face in contact with the charge pump case 510 to form the charge port 420P communicating with a discharge side of the charge pump body and a second end communicating with the second charge oil passage 422.

In the second charge oil passage 422, as shown in FIGS. 2 and 7, the check valves 425 are interposed for allowing flows of the pressure oil from the first charge oil passage 421 into the pair of first hydraulic fluid passages 410*a* and the pair of second hydraulic fluid passages 410*b* and for preventing backflows.

In this embodiment, each of the check valves 425 has a throttle that is disposed to be parallel with a check valve body.

In this embodiment, as shown in FIG. 7, the pair of first hydraulic fluid passages 410*a* and the pair of second hydraulic fluid passages 410*b* are formed substantially parallel to each other.

The second charge oil passage 422 extends in a direction orthogonal to the pair of first hydraulic fluid passages 410*a* and the pair of second hydraulic fluid passages 410*b* to communicate them.

At portions where the second charge oil passage 422 and the respective hydraulic fluid passages 410*a* and 410*b* are communicated with each other, the check valves 425 with the throttles are interposed.

With this configuration, it is possible to easily form the charge oil passage while miniaturizing the common port block 340.

Furthermore, the pump unit 300 according to this embodiment includes, as shown in FIG. 2, a charge pressure setting oil passage 550 in which a charge relief valve 556 for setting hydraulic pressure (charge hydraulic pressure) of the first charge oil passage 421 is interposed.

In this embodiment, the charge pressure setting oil passage 550 has a first end communicating with the first charge oil passage 421 and a second end communicating with a suction side of the supply oil passage 480.

The charge relief valve 556 is mounted in the charge pump case 510.

Although the second end of the charge pressure setting oil passage 550 communicates with the supply oil passage 480 in this embodiment, it is also possible that it communicates with an oil tank instead.

The first and second bypass oil passages 430*a* and 430*b* can selectively connect/disconnect between the pair of first hydraulic fluid passages 410*a* to/from each other and between the pair of second hydraulic fluid passages 410*b* to/from each other.

In other words, for driving the first and second hydraulic motor units 10 and 20 with the pump unit 300 to cause the vehicle to travel, the first and second bypass oil passages 430*a* and 430*b* are operated so that the pair of first hydraulic fluid passages 410*a* are disconnected from each other and, also, the pair of second hydraulic fluid passages 410*b* are disconnected from each other.

On the other hand, for towing a vehicle mounted with the pump unit 300, the first and second bypass oil passages 430*a* and 430*b* are operated so that the pair of first hydraulic fluid passages 410*a* are communicated with each other and, also, the pair of second hydraulic fluid passages 410*b* are communicated with each other. In this manner, freewheeling of the first and second hydraulic motor units 10 and 20 operatively connected to the driving wheels is allowed.

Concretely, the sealing plugs, which are screwed into the second ends opened at the outer surface (front surface in this embodiment) in the common port block 340 of the pair of first hydraulic fluid passages 411*a* and the pair of second hydraulic fluid passages 411*b*, are respectively provided with push pins 435 which can be operated from outside.

If the push pins 435 are pushed inside the port block 340 (downward in FIG. 7), the check valves 425 provided at the portions where the second charge oil passage 422 communicates with the pair of first operating oil passages 410*a* and the pair of second hydraulic fluid passages 410*b* can be released mechanically.

In other words, in this embodiment, the second charge oil passages 422 also function as the first and second bypass oil passages 430*a* and 430*b*.

Moreover, in this embodiment, the pump unit 300 includes, in addition to the aforementioned configuration, a cooling fan unit 800 operatively driven by the first pump shaft 310*a*.

Figure 8:
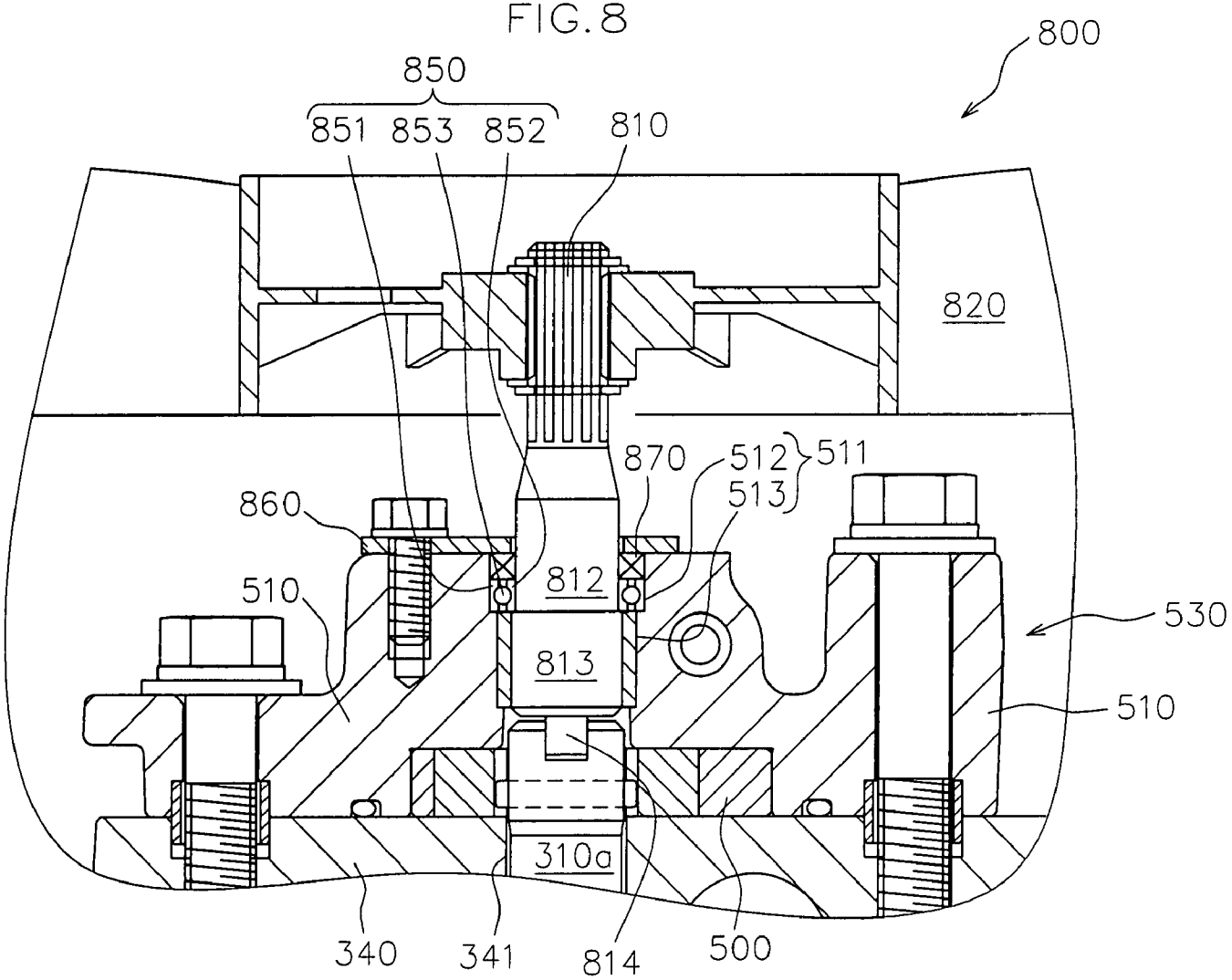
FIG. 8 is an enlarged view of a part VIII in FIG. 3.

FIG. 8 is an enlarged view of a part VIII in FIG. 3.

As shown in FIGS. 3 and 8, the common port block 340 is formed with a first through hole 341 for supporting the first pump shaft 310*a*.

The charge pump case 510 is formed with a second through hole 511 disposed concentrically with the first through hole 341.

Specifically, as shown in FIG. 8, the second through hole 511 has a large-diameter hole 512 opened at an outer surface on an opposite side to the common port block 340, and a small-diameter hole 513 extending from the large-diameter hole 512 through a step portion inward to approach the common port block 340.

The cooling fan unit 800 includes a fan shaft 810 connected to the first pump shaft 310*a* so as not to be rotatable relative to the shaft 310*a* about an axis while in contact with the second end of the first pump shaft 310*a* in the first through hole 341 or the second through hole 511, and a fan body 820 which is not rotatable relative to the fan shaft 810.

Specifically, the fan shaft 810 has a small-diameter portion 812 bearing-supported in the large-diameter hole 512 through a bearing member 850, a large-diameter portion 813 extending from the small-diameter portion 812 through a step portion inward to approach the port block 340 and positioned in the small-diameter hole 513, and a convex portion 814 provided to an end facing the first pump shaft 310*a*.

The convex portion 814 is connected to a concave portion formed in an opposed end face of the first pump shaft 310*a* in a relatively non-rotatable manner about the axis.

In this embodiment shown in the drawings, the fan shaft 810 is formed with the convex portion 814, and the first pump shaft 310*a* is formed with the concave portion. However, it is of course possible to reverse the concave portion and the convex portion, or to employ various other structures such as spline fitting for detachably connecting the shafts.

The bearing member 850 includes an outer ring body 851 engaged with the step portion of the second through hole 511, an inner ring body 852 engaged with the step portion of the fan shaft 810, and rolling elements 853 disposed between the outer ring body 851 and the inner ring body 852.

Furthermore, the pump unit 300 has a withdrawal preventing member for preventing the bearing member 850 from withdrawing outside from the large-diameter hole 512 of the second through hole 511.

In this embodiment, as the withdrawal preventing member, a retaining plate 860 having an opening through which the fan shaft 810 is inserted and detachably mounted to an outer surface of the charge pump case 510 is provided.

In FIG. 8, a reference numeral 870 is a seal member interposed between the bearing member 850 and the retaining plate 860. The seal member seals the first through hole 341 and the second through hole 511 against the outside and also functions as a spacer for preventing axial movement of the bearing member 850.

With this configuration, the fan shaft 810 can be connected to the first pump shaft 310*a* in a non-rotatable manner and, also, the fan shaft 810 can be supported in an immovable manner in the axial direction in spite of the simple structure.

Moreover, with this configuration, it is extremely easy to detach the cooling fan unit 800 only by detaching the retaining plate 860 to withdraw the fan shaft 810 and attaching a closing plate (not shown) in place of the retaining plate 860.

In this embodiment, the second end of the first pump shaft 310*a* extends outward from the common port block 340, and the first pump shaft 310*a* and the fan shaft 810 are connected to each other in the second through hole 511. Instead of this, it is also possible to connect the first pump shaft 310*a* and the fan shaft 810 in the first through hole 341 in the common port block 340 as shown in FIG. 9.

Figure 9:
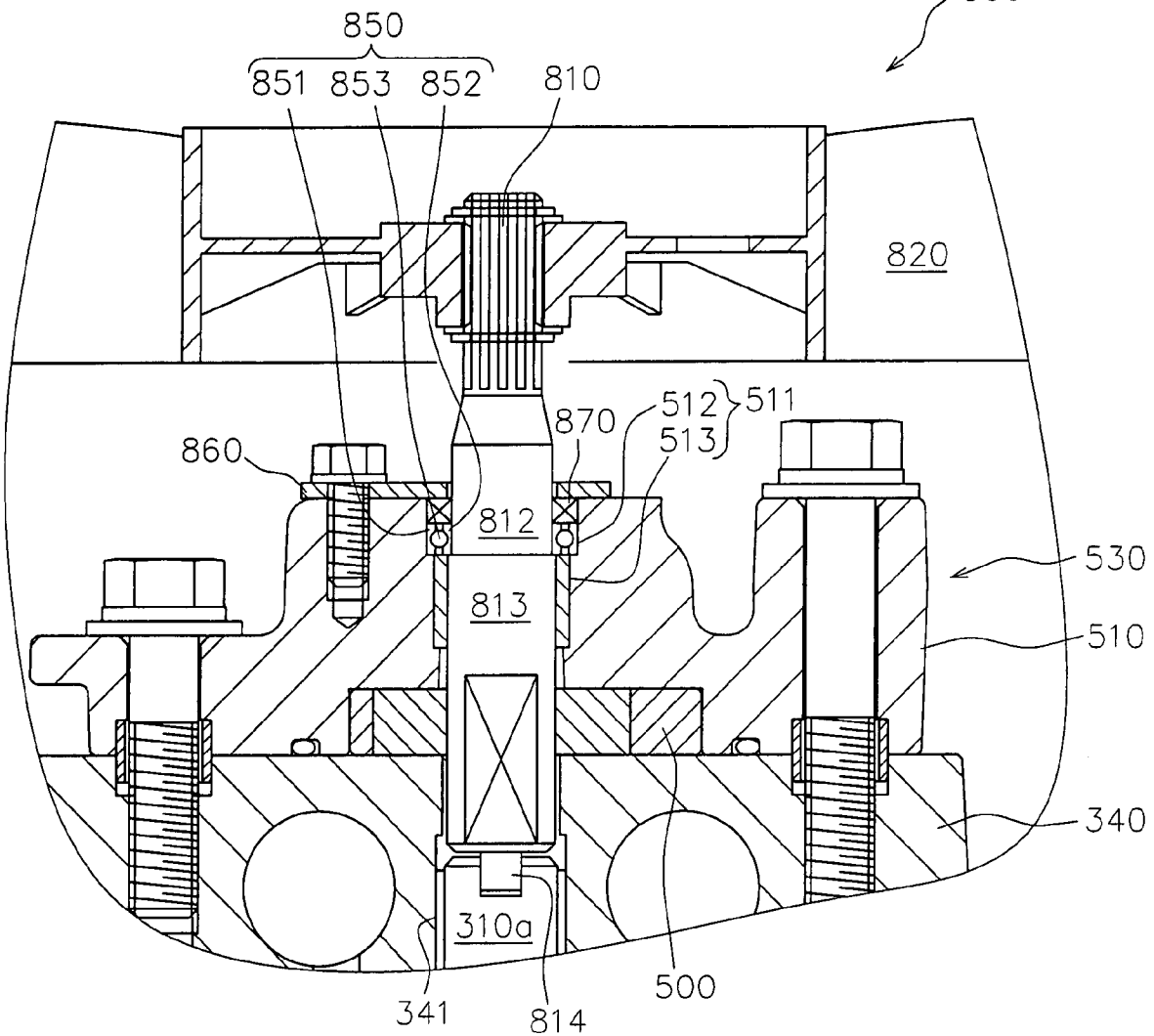
FIG. 9 is an enlarged partial view of a modified pump system in which a different connection structure of the cooling fan is applied.

In other words, as shown in FIG. 9, the second end of the first pump shaft 310*a* may be terminated in the first through hole 341 in the common port block 340, the connection end 814 of the fan shaft 810 may project into the first through hole 341, and the first pump shaft 310*a* and the fan shaft 810 may be connected to each other in the first through hole 341.

In the form shown in FIG. 9, the charge pump body 500 is driven by the fan shaft 810.

In such a form, in addition to the aforementioned effects, the charge pump body 500 can easily be added and detached.

Moreover, if a length and a shaft end shape of the second pump shaft 310*b* are the same as those of the first pump shaft 310*a*, the charge pump body 500 and/or the fan body 820 may be driven by an arbitrary pump shaft according to a vacant space when mounted on the vehicle.

Figure 10:
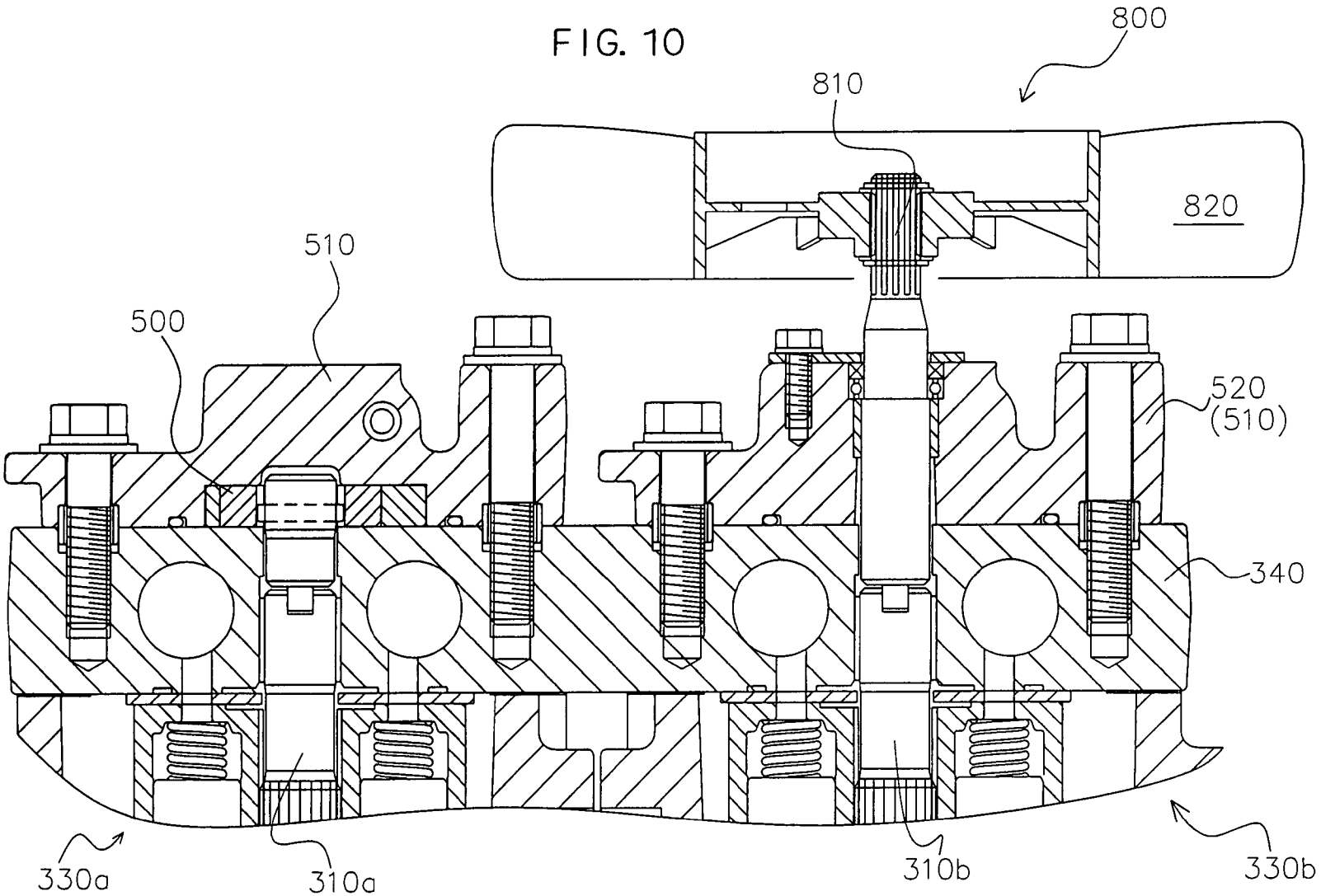
FIG. 10 is an enlarged partial view of a pump system modified to the pump system shown in FIG. 9.

As shown in FIG. 10, in addition to the charge pump case 510, a support case 520 that is mounted to the port block 340 at the same pitch as the charge pump case 510 may be prepared. The charge pump case 510 and the support case 520 may be connected to the port block 340 while corresponding to the respective pump shafts 310*a* and 310*b*. In this case, it is possible to selectively dispose the cooling fan unit 800 in a relatively larger vacant space and the charge pump unit 530 in a narrower vacant space around the ends of the pump shafts when the system is mounted on the vehicle.

In the form shown in FIG. 9 or 10, for detaching the charge pump unit 530 and the cooling fan unit 800, it is extremely easy to adapt to a change in specifications by attaching a closing plate (not shown) to the common port block 340 in such a manner as to close the opening of the first through hole 341 in place of the charge pump case 510 or the support case 520.

In the pump system 100A according to this embodiment with the aforementioned configuration, the following effects can be obtained in addition to the aforementioned various effects.

In the pump system 100A, the pump unit 300 is detachably connected to the base unit 200 supported on the vehicle frame 30. Herein, the pump unit 300 includes the first and second pump cases 330*a* and 330*b*, the first and second pump shafts 310*a* and 310*b*, the first and second hydraulic pump bodies 320*a* and 320*b*, the common port block 340, charge pump unit 530, and the cooling fan unit 800.

Therefore, it is possible to detach only the pump unit 300 without detaching the power transmission mechanism 280 (see FIG. 1(*a*)) for transmitting power from the driving source 40 to the base unit 200 to thereby increase efficiency of replacement and maintenance operation of the hydraulic pump bodies 320*a* and 320*b*.

The pump system 100A according to this embodiment has the single common port block 340 for the first and second hydraulic pump bodies 320*a* and 320*b* as described above.

Therefore, it is possible to efficiently supply pressure oil from the charge pump body 500 driven by one of the pump shafts (the first pump shaft 310*a* in this embodiment) to both the first and second hydraulic pump bodies 320*a* and 320*b* through the oil passages formed in the common port block 340.

Furthermore, in the working vehicle 1 in this embodiment, the driving source 40 having the vertically oriented driving shaft and the pump system 100A having the input shaft 210 disposed along the vertical direction are disposed on the upper face of the cross member 32, and the power transmission mechanism 280 from the driving source 40 to the pump system 100A is disposed under the cross member 32 as described above. The cooling fan unit 800 is provided at the upper portion of the pump system 100A and the oil tank 90 is disposed at substantially the same position in the vertical direction as the pump system 100A above the cross member 32 (see FIG. 1(*a*)).

In this configuration, cooling air from the cooling fan unit 800 can be efficiently guided toward the pump unit 300, the base unit 200, the oil tank 90, the driving source 40, and the conduits between the pump unit 300 and the motor units 10 and 20.

In this embodiment, the respective control shafts 324 in the first and second hydraulic pump bodies 320*a*, 320*b* extend in opposite directions as described above. However, the present invention is not limited to this form and it is also possible that the respective control shafts 324 in the first and second hydraulic pump bodies 320*a* and 320*b* are directed in the same direction.

Figure 11:
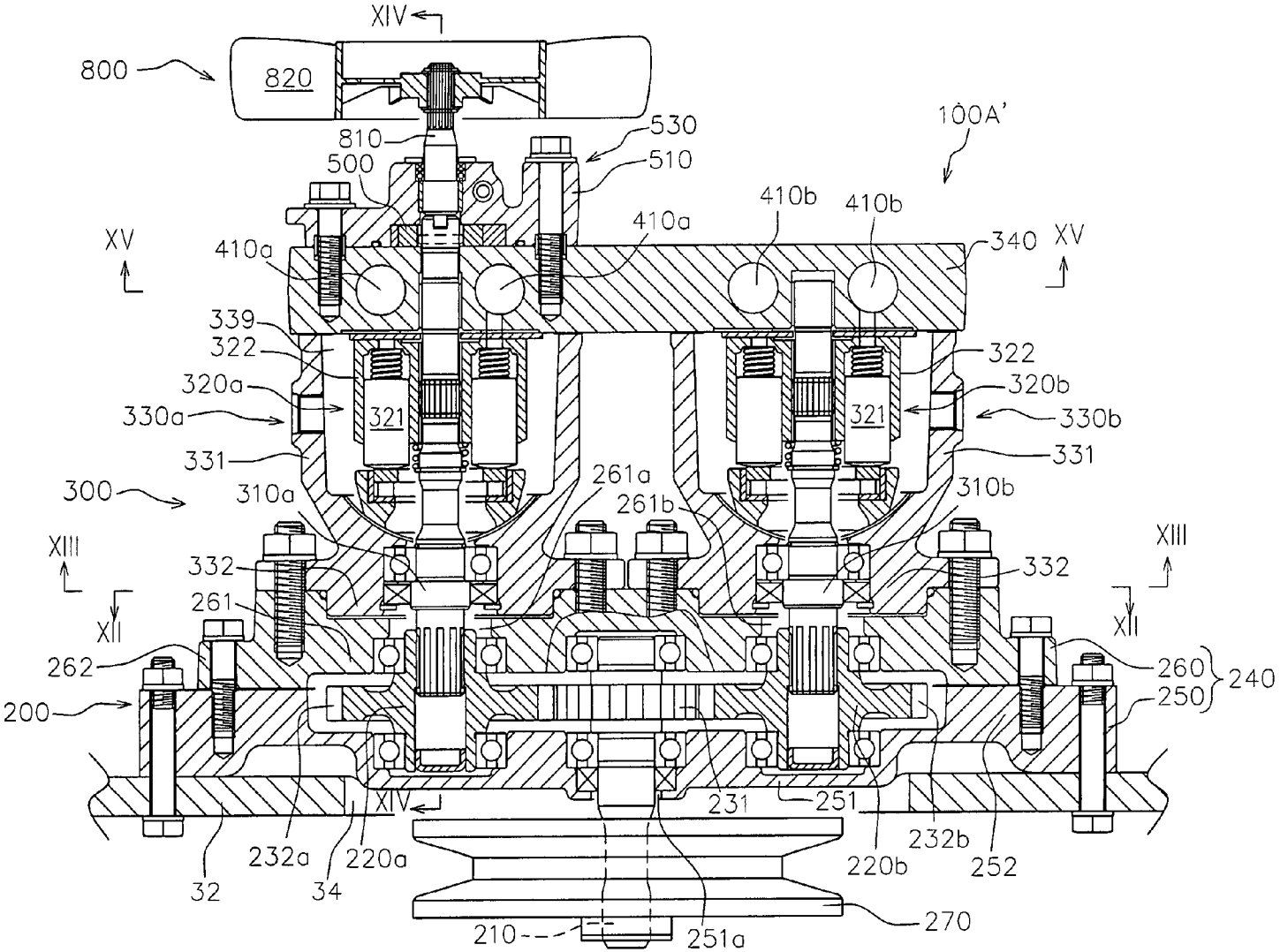
FIG. 11 is a vertical rear view of a pump system in which control shafts in first and second hydraulic pump bodies are directed in the same direction.
Figure 12:
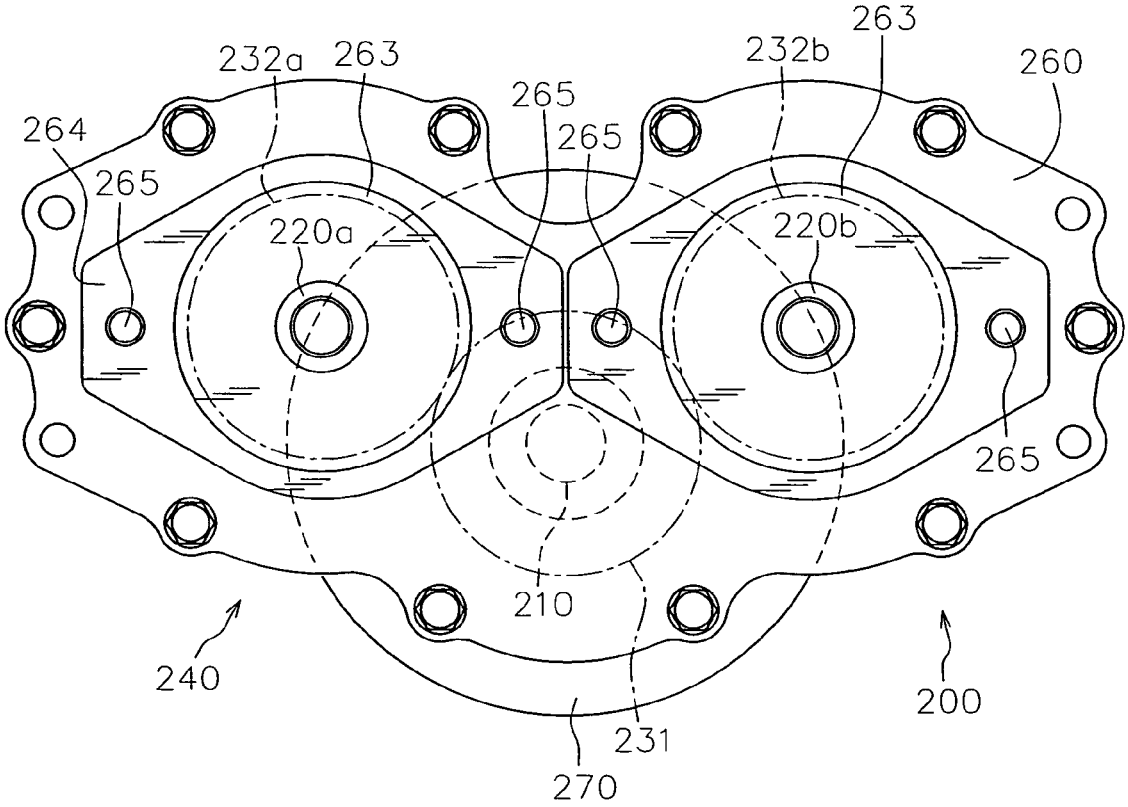
FIG. 12 is a sectional view taken along line XII-XII in FIG. 11.
Figure 13:
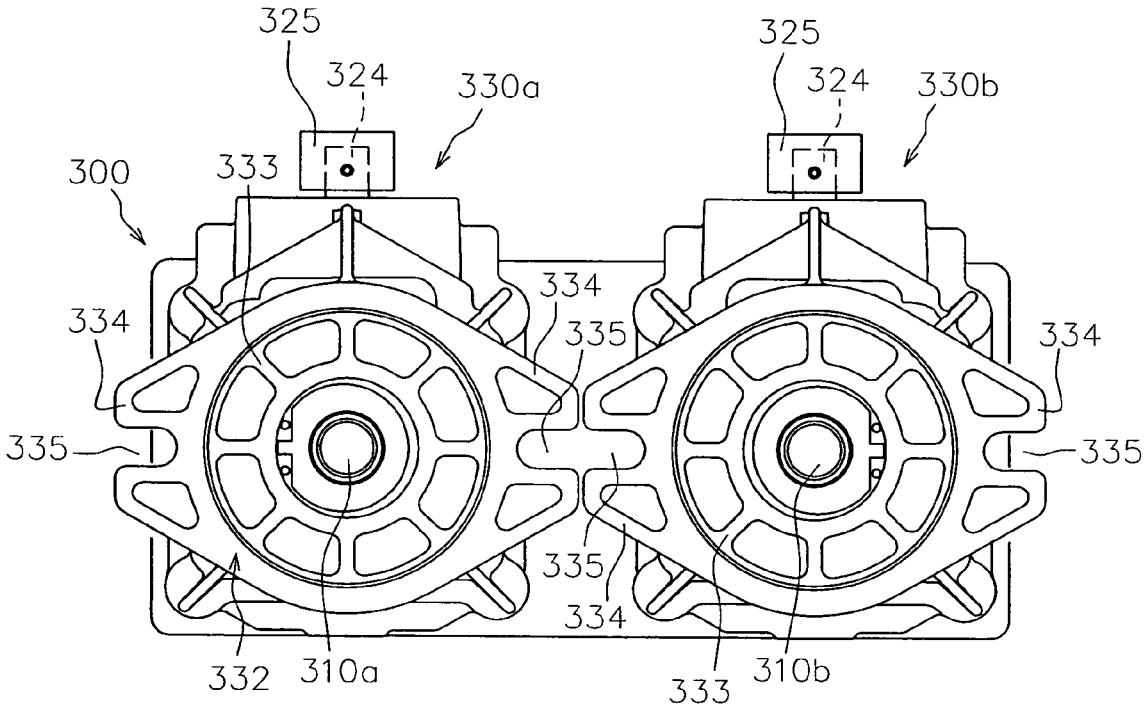
FIG. 13 is a sectional view taken along line XIII-XIII in FIG. 11.
Figure 14:
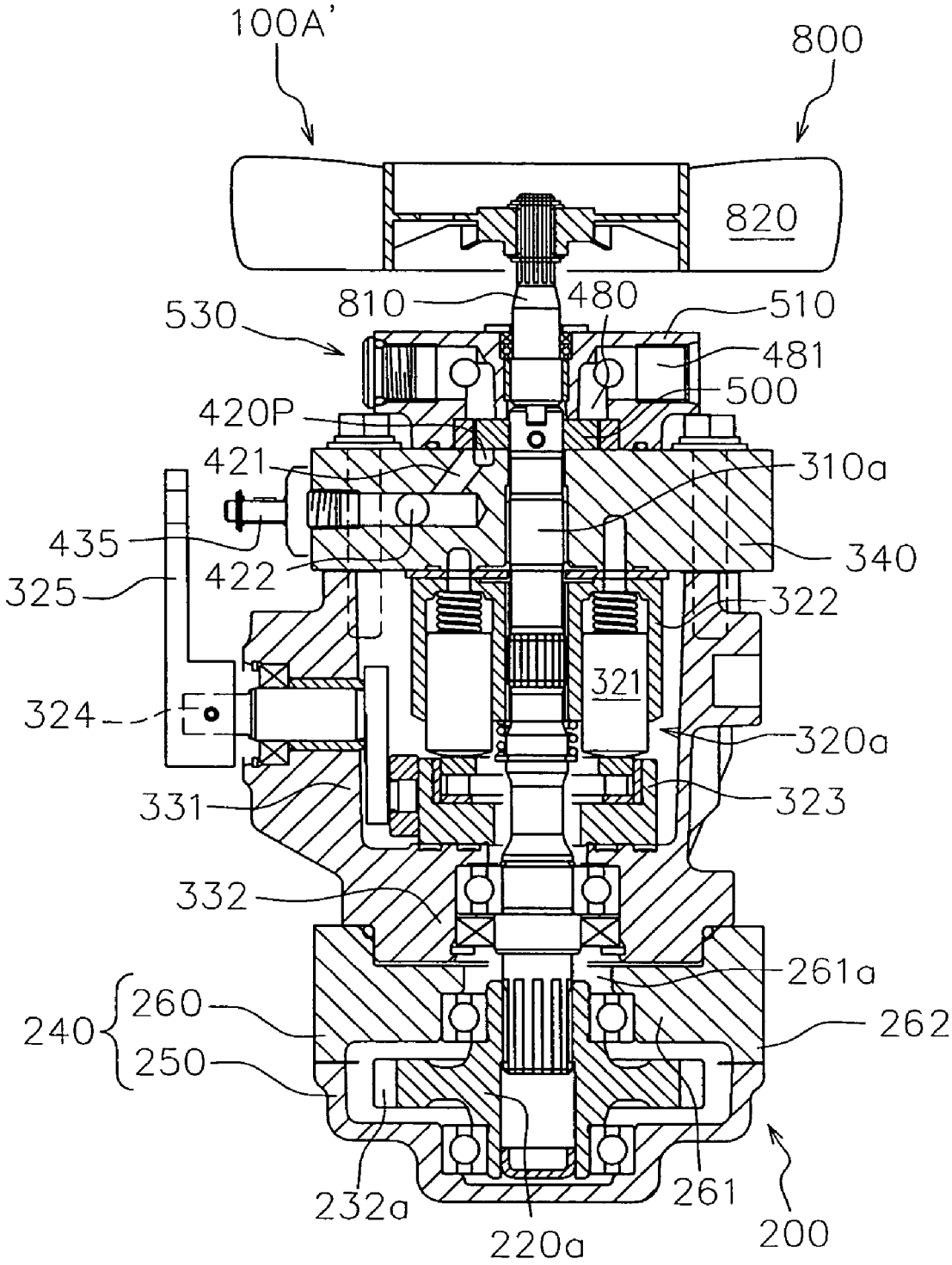
FIG. 14 is a sectional view taken along line XIV-XIV in FIG. 11.

FIG. 11 is a vertical rear view of the pump system 100A' in which the respective control shafts 324 in the first and second hydraulic pump bodies 320*a* and 320*b* are directed in the same direction. FIGS. 12 to 15 are sectional views taken along lines XII-XII, XIII-XIII, XIV-XIV, and XV-XV in FIG. 11, respectively.

The pump system 100A' shown in FIGS. 11 to 15 has the same configuration as the pump system 100A according to this embodiment except that positions of the first and second pump cases 330*a* and 330*b* around the pump shafts with respect to the base unit 200 and the oil passages in the common port block 340 are changed.

Figure 15:
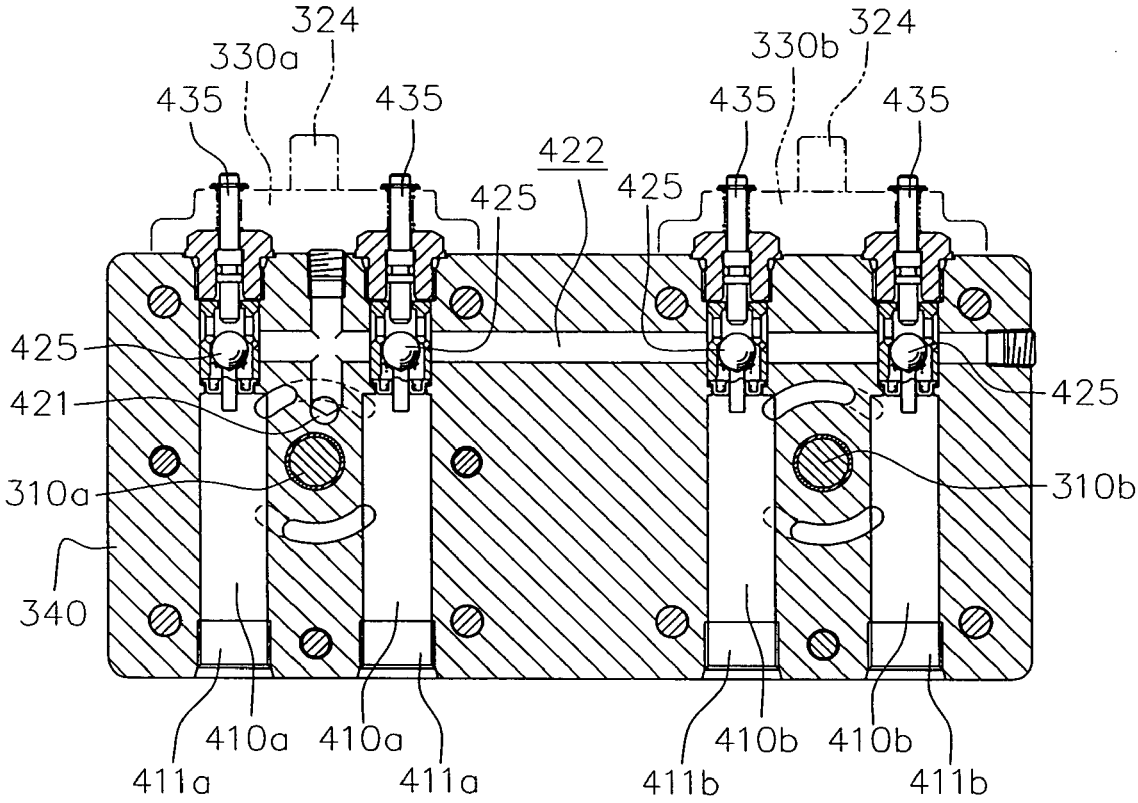
FIG. 15 is a sectional view taken along line XV-XV in FIG. 11.

Specifically, as shown in FIG. 15, in the pump system 100A', the pair of kidney-shaped oil suction/discharge ports provided to the port block 340 are respectively disposed with their longitudinal directions orthogonal to the pair of first hydraulic fluid passages 410*a*. In other words, in a plan view, each of the pair of oil suction/discharge ports overlaps both of the pair of first hydraulic fluid passages 410*a*. Therefore, one of the oil suction/discharge ports is formed so as to have a first end side formed to be deep and a second end side formed to be shallow to thereby communicate with only one of the first hydraulic fluid passages 410*a*. The other of the oil suction/discharge ports is formed so as to have a second end side formed to be deep and a first end side formed to be shallow to thereby communicate with only the other of the first hydraulic fluid passages 410*a*.

The pump system 100A' with such a configuration also exerts the same effects as the pump system 100A.

Embodiment 2

Another preferred embodiment of the pump system according to the present invention will be described below with reference to the accompanying drawings.

In this embodiment, the same or corresponding members as or to those in the first embodiment will be provided with the same reference numerals to omit detailed descriptions of them.

Figure 16:
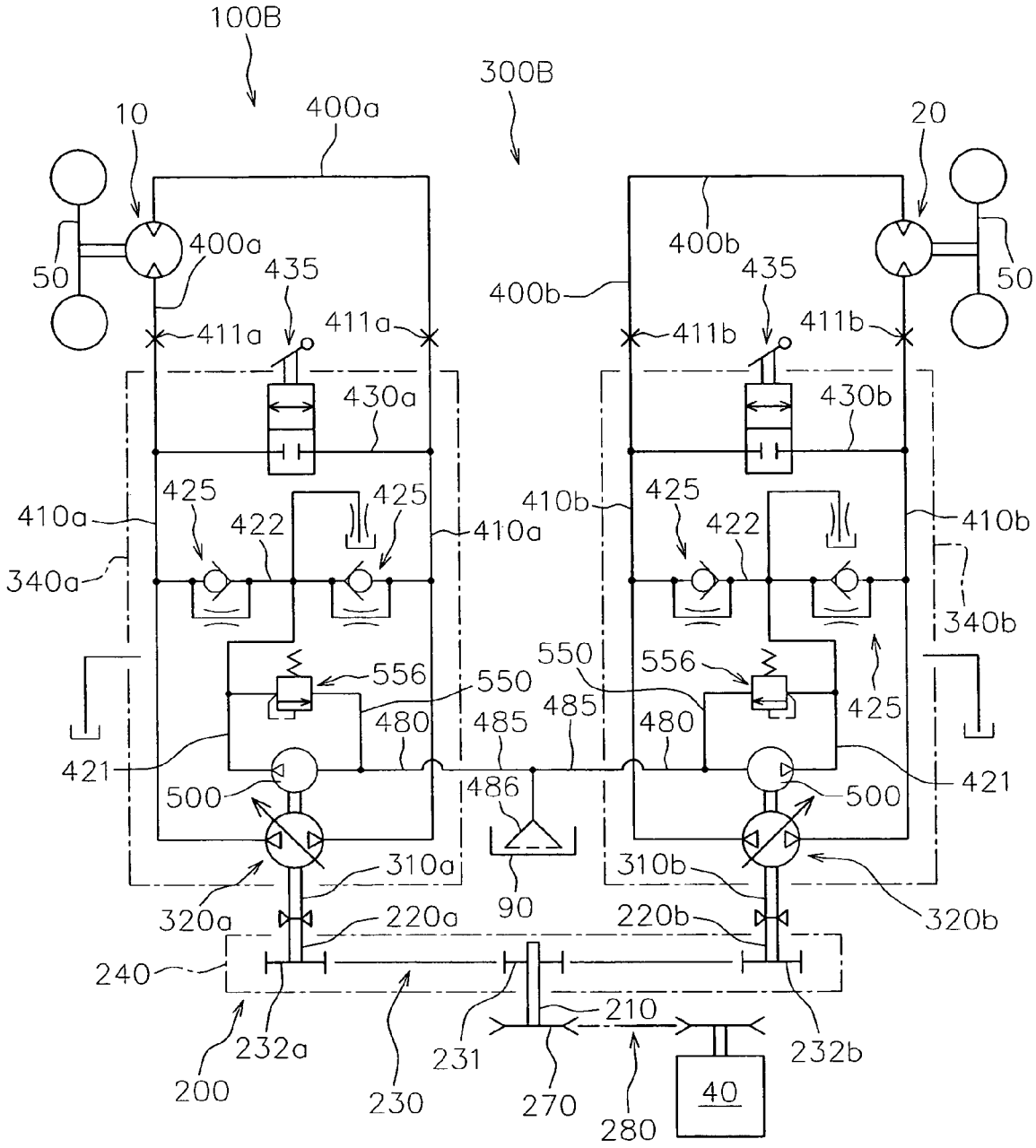
FIG. 16 is a hydraulic circuit diagram of a pump system according to a second embodiment of the present invention.
Figure 17:
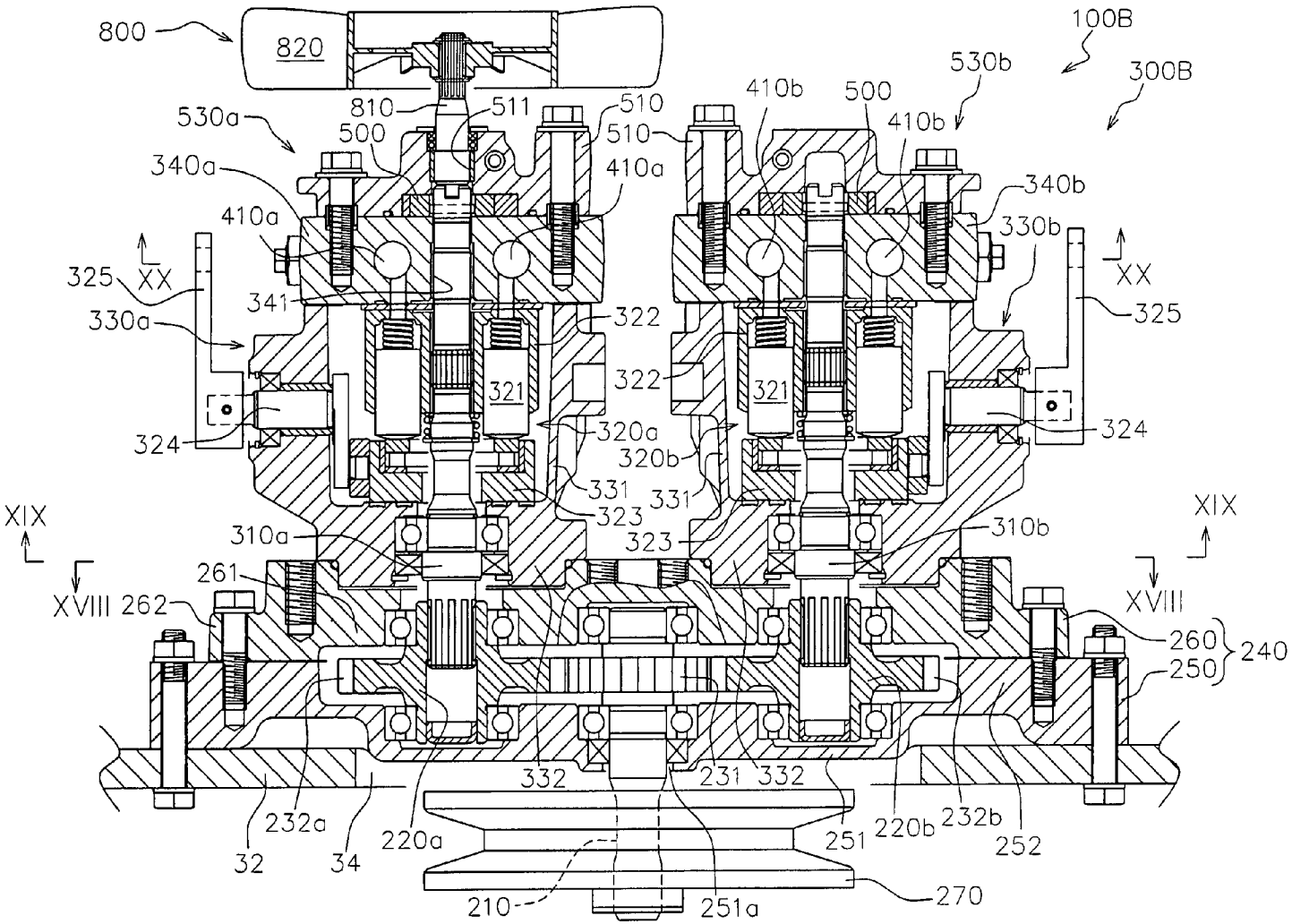
FIG. 17 is a vertical rear view of the pump system according to the second embodiment.
Figure 18:
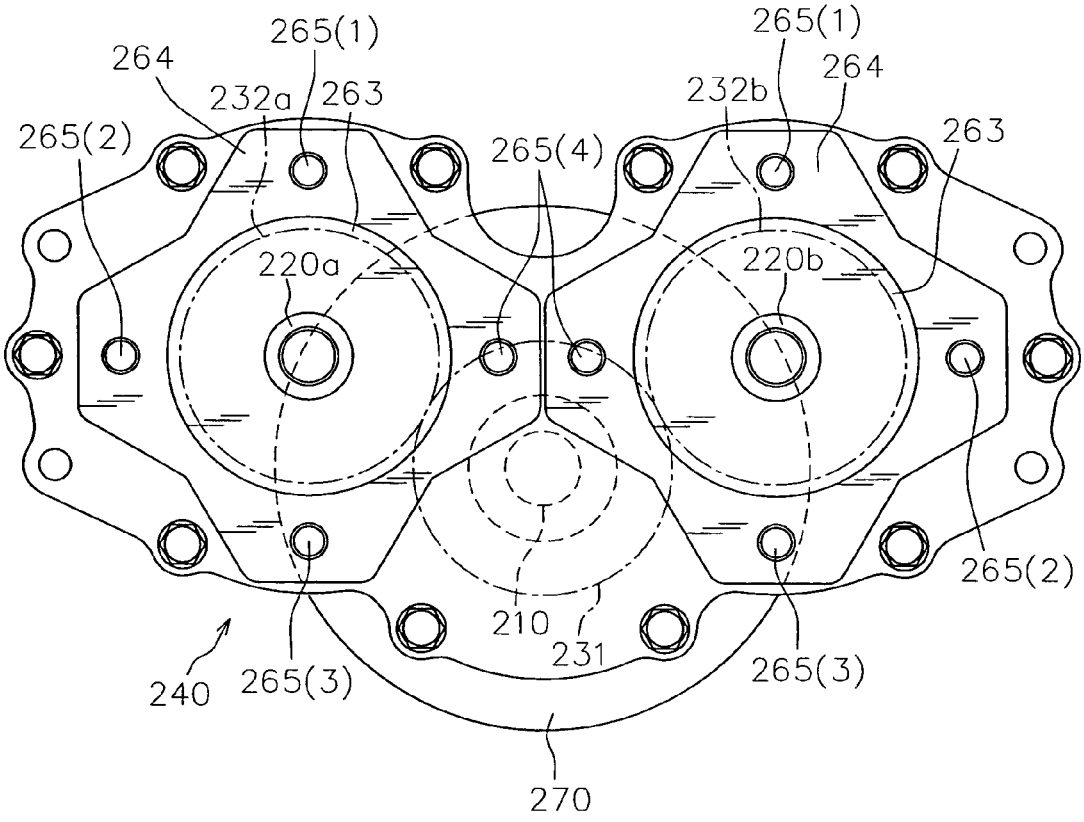
FIG. 18 is a sectional view taken along line XVIII-XVIII in FIG. 17.
Figure 19:
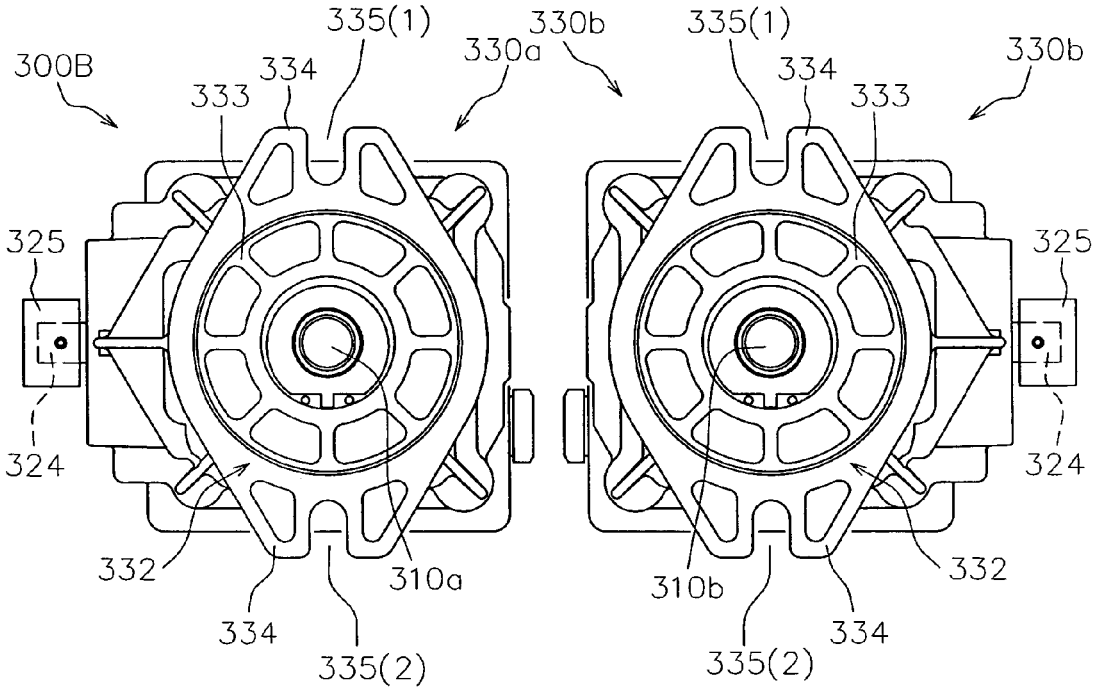
FIG. 19 is a sectional view taken along line XIX-XIX in FIG. 17.
Figure 20:
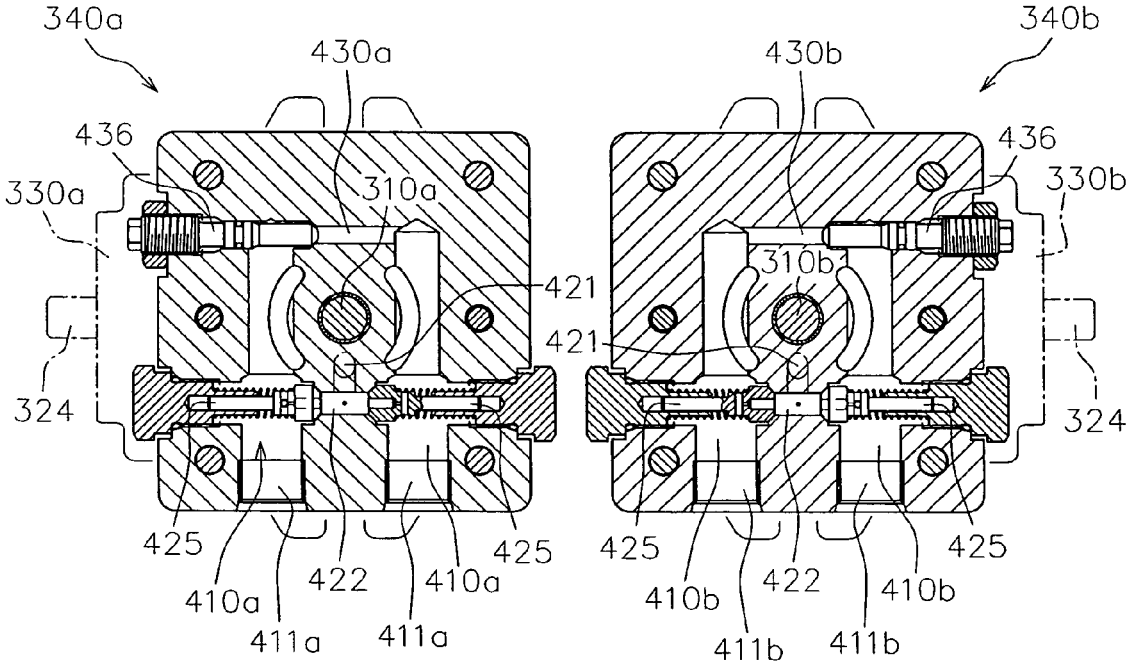
FIG. 20 is a sectional view taken along lines XX-XX in FIG. 17.

FIG. 16 is a hydraulic circuit diagram of a pump system 100B according to this embodiment. FIG. 17 is a vertical rear view of the pump system 100B according to this embodiment. FIGS. 18 to 20 are sectional views taken along lines XVIII-XVIII, XIX-XIX, and XX-XX in FIG. 17, respectively.

The pump system 100B according to this embodiment includes a port block for each of a plurality of pump cases.

In other words, the pump system 100B includes the base unit 200 and a pump unit 300B detachably connected to the base unit 200.

The pump unit 300B includes first and second port blocks 340*a*, 340*b* in place of the common port block 340 in the pump unit 300 in the first embodiment.

Concretely, the pump unit 300B includes the first and second pump shafts 310*a* and 310*b*, the first and second hydraulic pump bodies 320*a* and 320*b*, the first and second pump cases 330*a* and 330*b*, a first port block 340*a* detachably connected to the first pump case 330*a* to close an opening of the first pump case 330*a*, and a second port block 340*b* detachably connected to the second pump case 330*b* to close an opening of the second pump case 330*b*.

In the first port block 340*a*, the check valve 425 with the throttle is interposed in a portion where the second charge oil passage 422 and each hydraulic fluid passage 410*a* communicate with each other, and the first bypass oil passage 430*a* for communicating between the pair of first hydraulic fluid passages 410*a* and a switching valve 436 with which the first bypass oil passage 430*a* can be opened/interrupted from outside are disposed.

Likewise, in the second port block 340*b*, the check valve 425 with the throttle is interposed in a portion where the second charge oil passage 422 and each hydraulic fluid passage 410*b* communicate with each other, and the second bypass oil passage 430*b* for communicating between the pair of second hydraulic fluid passages 410*b* and the switching valve 436 with which the second bypass oil passage 430*b* can be opened/interrupted from outside are disposed.

Furthermore, the pump unit 300B includes first and second charge pump units 530*a* and 530*b* operatively driven by the first and second pump shafts 310*a* and 310*b*, respectively, and the cooling fan unit 800 operatively driven by the first pump shaft 310*a*.

The cooling fan unit 800 may be operatively driven by the second pump shaft 310*b* instead of the first pump shaft 310*a*. Alternatively, two cooling fan units 800 may operatively driven by both the first and second pump shafts 310*a* and 310*b* may be provided.

The first and second pump cases 330*a* and 330*b* can be connected to the base unit 200 in a plurality of positions about the corresponding pump shafts 310*a* and 310*b*, respectively.

Concretely, a plurality of screw holes 265(1) to 265(4) are provided around each of the pump shafts in an outer surface of the second housing portion 260 in the base unit 200.

By fastening the first and second pump cases 330*a* and 330*b* with their engaging holes or engaging grooves 335 positioned on predetermined screw holes out of the plurality of screw holes 265(1) to 265(4), the first and second pump cases 330*a* and 330*b* can be connected to the base unit 200 at a plurality of different positions around the corresponding pump shafts.

In this embodiment, as shown in FIG. 18, in the outer surface of the second housing portion 260, the first to fourth screw holes 265(1) to 265(4) are formed at intervals of 90° around the first and second pump shafts 310*a* and 310*b*.

On the other hand, each of the first and second pump cases 330*a* and 330*b* has the pair of first and second engaging holes or engaging grooves 335(1) and 335(2) at an angle of 180° with respect to each other about the corresponding pump shaft.

If the first and second engaging holes 335(1) and 335(2) in the first and second pump cases 330*a* and 330*b* are fastened to the corresponding first and third screw holes 265(1) and 265(3), respectively, the respective control shafts 324 of the first and second hydraulic pump bodies 320*a* and 320*b* are directed outward in the vehicle width direction.

Figure 21:
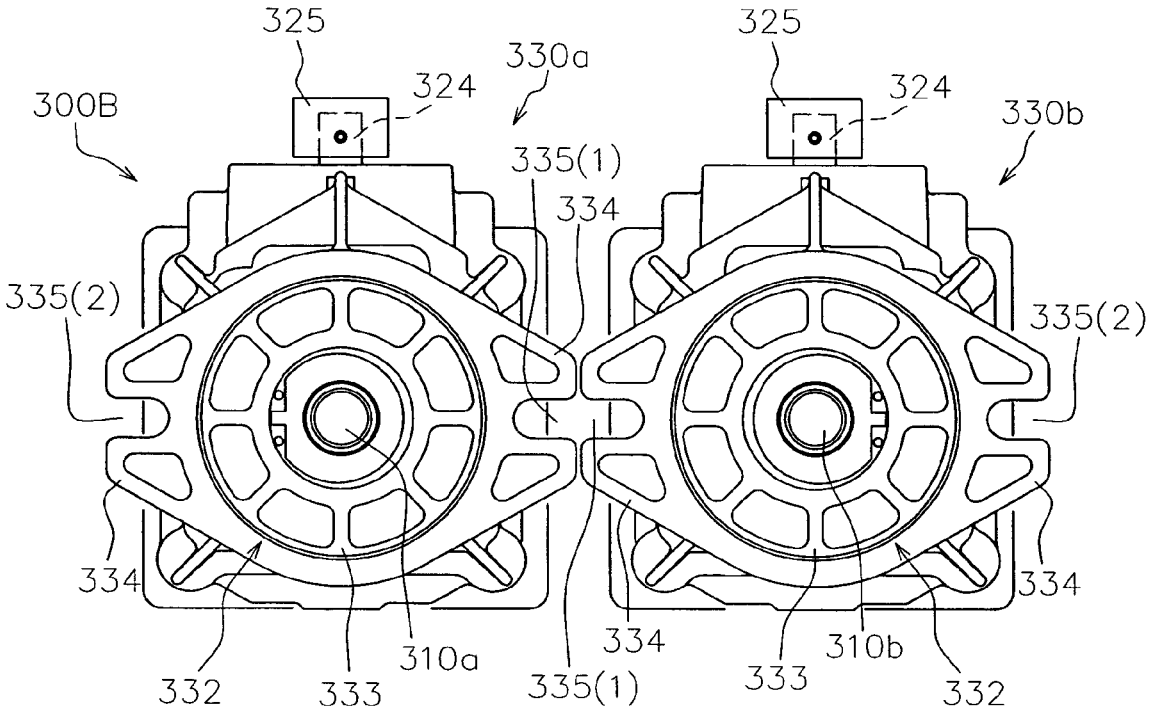
FIG. 21 is an end view of the pump system shown in FIGS. 16-20, in which a relative position between a pump case and a base unit is changed.
Figure 22:
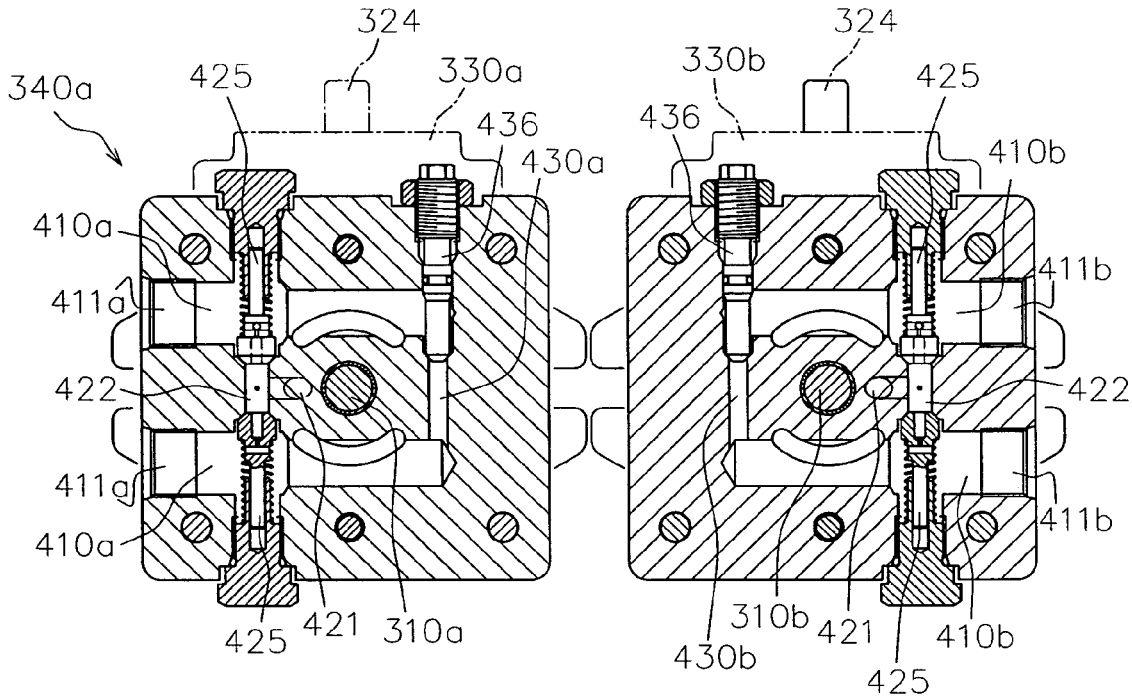
FIG. 22 is a cross sectional view of a port block of the pump system shown in FIG. 21.

Instead of this, if the first and second engaging holes 335(1) and 335(2) are fastened to the corresponding fourth and second screw holes 265(4) and 265(2), respectively, the respective control shafts 324 of the first and second hydraulic pump bodies 320*a* and 320*b* are directed rearward with respect to the vehicle (see FIGS. 21 and 22). If the first and second engaging holes 335(1) and 335(2) are fastened to the corresponding second and fourth screw holes 265(2) and 265(4), respectively, the respective control shafts 324 of the first and second hydraulic pump bodies 320*a* and 320*b* are directed forward with respect to the vehicle (not shown).

In the pump system 100B with this configuration, in addition to the effects in the first embodiment, the control shafts 324 can be directed in desired directions and the pump system 100B can easily be applied to various working vehicles.

Although two charge pump units (first and second charge pump units 530*a* and 530*b*) are provided in this embodiment, it is also possible that only one charge pump unit is provided like in the first embodiment.

For example, if only the first charge pump unit 530*a* driven by the first pump shaft 310*a* is provided, the pressure oil from the first charge pump unit 530*a* can be supplied to the second port block 340*b* through a conduit.

Although the charge pump bodies 500 are driven by the corresponding pump shafts 310*a* and 310*b* in the aforementioned respective embodiments, an auxiliary pump unit for supplying hydraulic fluid to an external hydraulic system may be provided instead of or in addition to this configuration.

Embodiment 3

Still another preferred embodiment of the pump system according to the invention will be described below with reference to the accompanying drawings.

In this embodiment, the same or corresponding members as or to those in the first or second embodiment will be provided with the same reference numerals to omit detailed descriptions of them.

Figure 23:
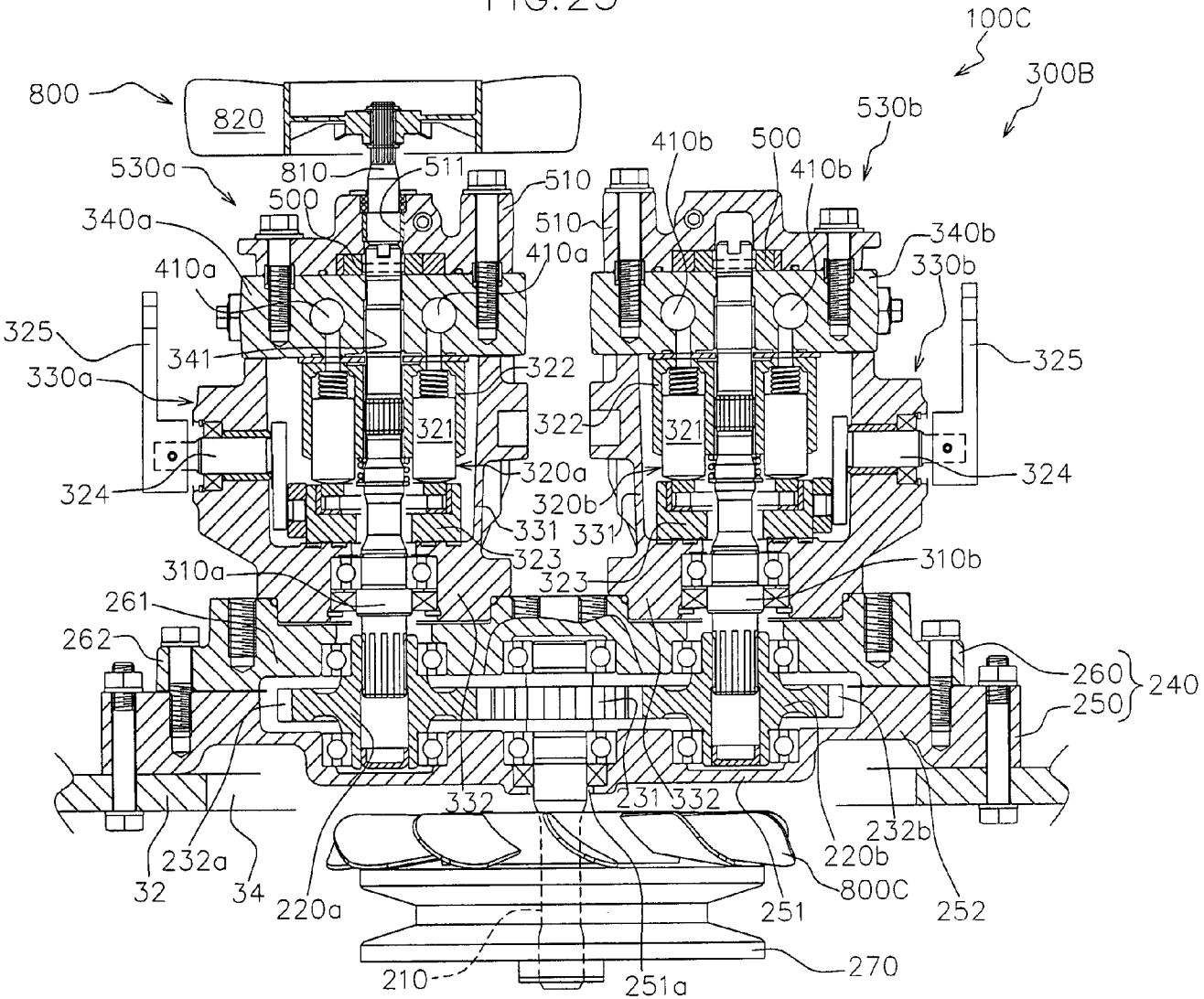
FIG. 23 is a vertical rear view of a pump system according to a third embodiment.

FIG. 23 is a vertical rear view of a pump system 100C according to this embodiment.

As shown in FIG. 23, the pump system 100C further includes a second cooling fan 800C driven for rotation by the input part in the pump system 100B according to the second embodiment.

Specifically, the second cooling fan 800C is supported on the input part (the input shaft 210 in the form shown in the drawing) in a relatively non-rotatable manner so as to be positioned between the driven pulley 270 and the base housing 240.

By providing such a second cooling fan 800C, it is possible to effectively cool the oil stored in the base housing 240.

Although the form in which the second cooling fan 800C is provided to the pump system 100B according to the second embodiment has been described in this embodiment, it is of course possible that the second cooling fan 800C is provided to the pump system 100A according to the first embodiment.

Embodiment 4

Yet another preferred embodiment of the pump system according to the invention will be described below with reference to the accompanying drawings.

In this embodiment, the same or corresponding members as or to those in the first to third embodiments will be provided with the same reference numerals to omit detailed descriptions of them.

Figure 24:
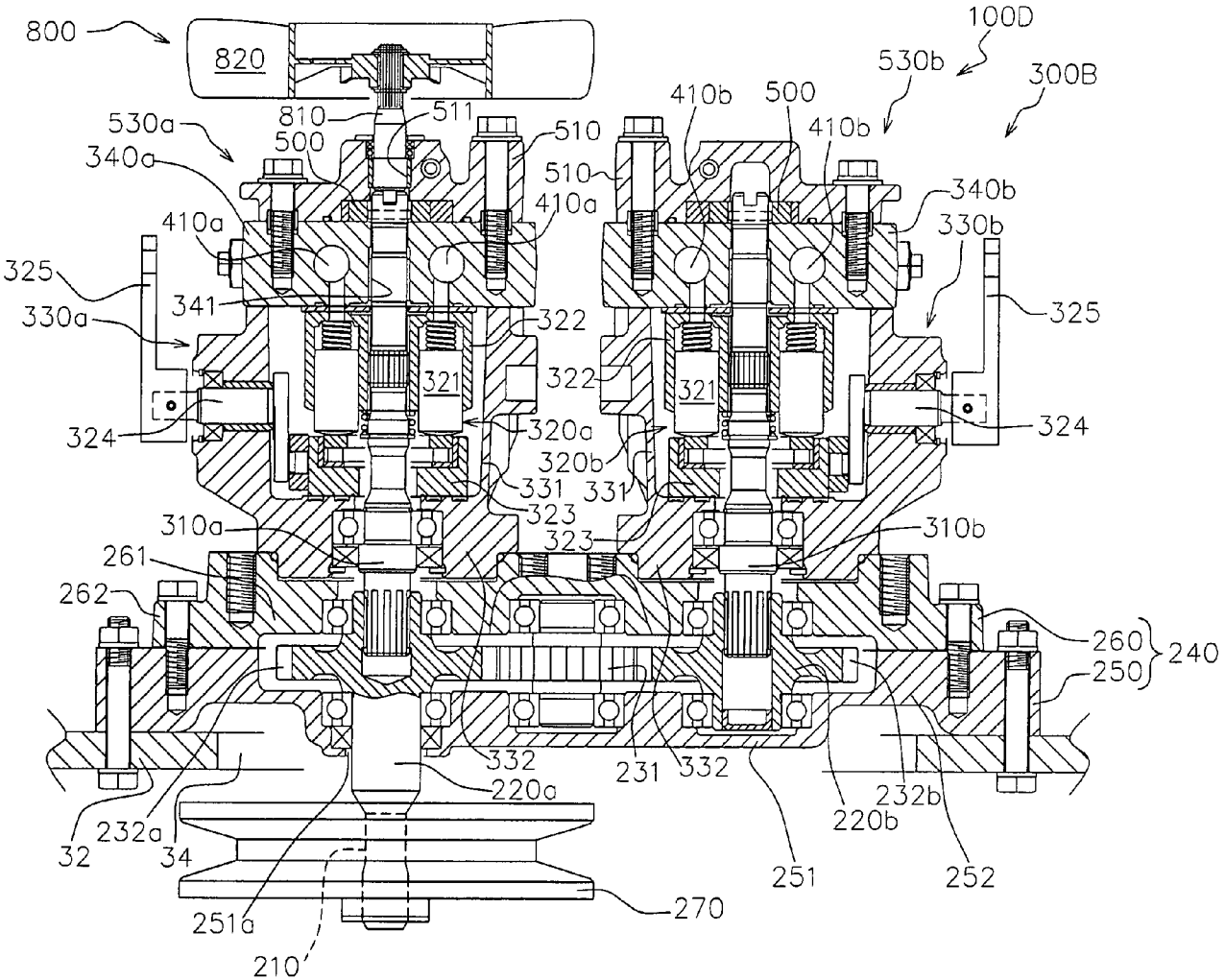
FIG. 24 is a vertical rear view of a pump system according to a fourth embodiment.

FIG. 24 is a vertical rear view of a pump system 100D according to this embodiment.

As shown in FIG. 24, in the pump system 100D, either one of the first and second output shafts 220*a* and 220*b* (the first output shaft 220*a* in this embodiment shown in the drawing) forms the single input part which can be operatively connected to the driving source 40.

In other words, each of the pump systems 100A to 100C according to the first to third embodiments includes the input shaft 210 as the input part.

On the other hand, in the pump system 100D according to this embodiment, an end of the first output shaft 220*a* on an opposite side to the first hydraulic pump body 320*a* extends outside the base housing 240 and the extension is used as the input part.

It is of course possible that an end of the second output shaft 220*b*, instead of the first output shaft 220*a*, on an opposite side to the second hydraulic pump body 320*b* extends outside the base housing 240 and that the extension is used as the input part.

It is also possible that the input part is formed of either one of the first and second pump shafts 310*a* and 310*b* instead of either one of the first and second output shafts 220*a* and 220*b*.

In other words, an end of either one of the first and second pump shafts 310*a* and 310*b* on an opposite side to the port blocks 340*a* and 340*b* may extend outside the base housing

240. The one of the first and second pump shafts 310*a* and 310*b* may be used as the input part.

Although the form including the first and second port blocks 340*a* and 340*b* like the pump system 100B according to the second embodiment has been described as an example in this embodiment, it is of course possible to use either one of the first and second output shafts 220*a* and 220*b* or to use either one of the first and second pump shafts 310*a* and 310*b* as the input part in the pump system 100A according to the first embodiment.

Furthermore, in the form in which either one of the first and second output shafts 220*a* and 220*b* or either one of the first and second pump shafts 310*a* and 310*b* is used as the input part as described above, it is possible to provide the second cooling fan 800C like the third embodiment.

This specification is by no means intended to restrict the present invention to the preferred embodiments set forth therein. Various modifications to the pump system and the pump unit as described herein, may be made by those skilled in the art without departing from the spirit and scope of the present invention as defined in the appended claims.

What is claimed is:

1. A pump system comprising:

a base unit including: a base housing with first and second end walls that face each other; an input part supported by the first and second end walls in a state capable of being operatively connected to a driving source through a through hole formed in the first end wall; and a plurality of output parts supported by the first and second end walls in a state of being capable of outputting power, which has been transmitted from the input part, through a plurality of access openings formed in the second end wall; the base unit capable of being mounted to a support member; and a pump unit including a plurality of pump shafts, a plurality of hydraulic pump bodies respectively driven by the plurality of pump shafts, a plurality of pump cases for respectively surrounding the plurality of hydraulic pump bodies while supporting the plurality of pump shafts, a plurality of output-adjusting members for adjusting suction/discharge rates of the corresponding hydraulic pump bodies, and a plurality of control shafts supported by the corresponding pump cases in a rotatable manner around its axis line so as to operate the corresponding output-adjusting members, the pump unit detachably connected to the base unit, wherein:

each of the plurality of hydraulic pump bodies comprises a cylinder block and a piston unit;

each of the plurality of pump cases includes an end wall detachably connected to the second end wall of the base housing, a peripheral wall extending from the end wall along the corresponding pump shaft in a direction apart from the base housing, and an opening provided on a side of the peripheral wall that is opposite to the end wall, the opening having a size that allows the corresponding hydraulic pump body to pass therethrough, the openings of the plurality of pump cases are closed by a single common port block, each of the plurality of pump cases is capable of being connected to the base housing and the common port block at a plurality of positions around the axis line of the corresponding pump shaft independently of the other of the plurality of pump cases, each of the plurality of output parts is formed by a hollow shaft that is accommodated in an inner space of the base housing in a state capable of being accessed from an outside of the base housing through a corresponding access opening, the end wall of the pump case and the second end wall of the base housing are brought into contact with each other so as to be in a concavo-convex engagement, and each of the plurality of pump shafts is inserted into the corresponding hollow shaft through the access opening so as to be relatively non-rotatable with respect thereto by means of causing the end wall of the pump case and the second end wall of the base housing to be in the concavo-convex engagement.

2. A pump system according to claim 1, further comprising:

at least one auxiliary pump unit operatively driven by one of the plurality of pump shafts, wherein the auxiliary pump unit includes an auxiliary pump body operatively driven by an end of the corresponding pump shaft on an opposite side to an end of the pump shaft to be connected to the output part, and an auxiliary pump case for surrounding the auxiliary pump body.

3. A pump system according to claim 1, further comprising:

at least one cooling fan operatively driven by one of the plurality of pump shafts, wherein the cooling fan is operatively driven by an end of the corresponding pump shaft on an opposite side to an end of the pump shaft to be connected to the output part.

4. A pump system according to claim 1, wherein the base unit includes an input shaft forming the input part and a plurality of output shafts respectively forming the plurality of output parts.

* * * * *